US007966191B2

(12) United States Patent
Schuijers et al.

(10) Patent No.: US 7,966,191 B2
(45) Date of Patent: Jun. 21, 2011

(54) METHOD AND APPARATUS FOR GENERATING A NUMBER OF OUTPUT AUDIO CHANNELS

(75) Inventors: Erik Gosuinus Petrus Schuijers, Eindhoven (NL); Gerard Herman Hotho, Eindhoven (NL); Heiko Purnhagen, Sundbyberg (SE); Wolfgang Alexander Schildbach, Nuremberg (DE); Holger Horich, Nuremberg (DE); Hans Magnus Kristofer Kjorling, Solna (SE); Karl Jonas Roden, Solna (SE)

(73) Assignees: Koninklijke Philips Electronics N.V., Eindhoven (NL); Coding Technologies AB, Stockholm (SE)

( * ) Notice: Subject to any disclaimer, the term of this patent is extended or adjusted under 35 U.S.C. 154(b) by 829 days.

(21) Appl. No.: 11/995,538

(22) PCT Filed: Jul. 7, 2006

(86) PCT No.: PCT/IB2006/052309

§ 371 (c)(1),
(2), (4) Date: Jan. 13, 2008

(87) PCT Pub. No.: WO2007/007263

PCT Pub. Date: Jan. 18, 2007

(65) Prior Publication Data

US 2008/0255856 A1 Oct. 16, 2008

(30) Foreign Application Priority Data

Jul. 14, 2005 (EP) ..... 05106466

(51) Int. Cl.
*G10L 19/00* (2006.01)

(52) U.S. Cl. ..... 704/500; 704/200.1

(58) Field of Classification Search ..... 704/500–504, 704/200.1

See application file for complete search history.

(56) References Cited

U.S. PATENT DOCUMENTS

| | | | | |
|---|---|---|---|---|
| 6,625,218 | B1 * | 9/2003 | Iganami | 375/240.26 |
| 7,502,743 | B2 * | 3/2009 | Thumpudi et al. | 704/500 |
| 7,720,676 | B2 * | 5/2010 | Philippe et al. | 704/201 |
| 2006/0265087 | A1 * | 11/2006 | Philippe et al. | 700/94 |
| 2007/0233467 | A1 * | 10/2007 | Oshikiri | 704/201 |

FOREIGN PATENT DOCUMENTS

WO WO2004008805 A1 1/2004

OTHER PUBLICATIONS

Eshet et al.; Multistage Quantization via Conditional Hierarchical Mapping; ACSSC 2003, pp. 860-864, vol. 1.*

J. Herre et al., The Reference Model Architecture for MPEG Spatial Audio Coding, Audio Engineering Society Convention paper, NY, NY, US, May 2005, pp. 1-13, XP009059973.

* cited by examiner

*Primary Examiner* — Abul Azad

(74) *Attorney, Agent, or Firm* — Michael A. Glenn; Glenn Patent Group

(57) ABSTRACT

An audio encoder (109) has a hierarchical encoding structure and generates a data stream comprising one or more audio channels as well as parametric audio encoding data. The encoder (109) comprises an encoding structure processor (305) which inserts decoder tree structure data into the data stream. The decoder tree structure data comprises at least one data value indicative of a channel split characteristic for an audio channel at a hierarchical layer of the hierarchical decoder structure and may specifically specify the decoder tree structures to be applied by a decoder. A decoder (115) comprises a receiver (401) which receives the data stream and a decoder structure processor (405) for generating the hierarchical decoder structure in response to the decoder tree structure data. A decode processor (403) then generates output audio channels from the data stream using the hierarchical decoder structure.

31 Claims, 10 Drawing Sheets

METHOD AND APPARATUS FOR GENERATING A NUMBER OF OUTPUT AUDIO CHANNELS

The invention relates to audio encoding and/or decoding using hierarchical encoding structures and/or hierarchical decoder structures.

In the field of audio processing, it is well known to convert a number of audio channels into another, larger number of audio channels. Such a conversion may be performed for various reasons. For example, an audio signal may be converted into another format to provide an enhanced user experience. E.g. traditional stereo recordings only comprise two channels whereas modern advanced audio systems typically use five or six channels, as in the popular 5.1 surround sound systems. Accordingly, the two stereo channels may be converted into five or six channels in order to take full advantage of the advanced audio system.

Another reason for a channel conversion is coding efficiency. It has been found that e.g. stereo audio signals can be encoded as single channel audio signals combined with a parameter bit stream describing the spatial properties of the audio signal. The decoder can reproduce the stereo audio signals with a very satisfactory degree of accuracy. In this way, substantial bit rate savings may be obtained.

There are several parameters which may be used to describe the spatial properties of audio signals. One such parameter is the inter-channel cross-correlation, such as the cross-correlation between the left channel and the right channel for stereo signals. Another parameter is the power ratio of the channels. In so-called (parametric) spatial audio (en)coders these and other parameters are extracted from the original audio signal so as to produce an audio signal having a reduced number of channels, for example only a single channel, plus a set of parameters describing the spatial properties of the original audio signal. In so-called (parametric) spatial audio decoders, the original audio signal is reconstructed.

Spatial Audio Coding is a recently introduced technique to efficiently code multi-channel audio material. In Spatial Audio Coding, an M-channel audio signal is described as an N-channel audio signal plus a set of corresponding spatial parameters where N is typically smaller than M. Hence, in the Spatial Audio encoder the M-channel signal is down-mixed to an N-channel signal and the spatial parameters are extracted. In the decoder, the N-channel signal and the spatial parameters are employed to (perceptually) reconstruct the M-channel signal.

Such spatial audio coding preferably employs a cascaded or tree-based hierarchical structure comprising standard units in the encoder and the decoder. In the encoder, these standard units can be down-mixers combining channels into a lower number of channels such as 2-to-1, 3-to-1, 3-to-2, etc. down-mixers, while in the decoder corresponding standard units can be up-mixers splitting channels into a higher number of channels such as 1-to-2, 2-to-3 up-mixers.

However, a problem with such an approach is that the decoder structure must match the structure of the encoder. Although this may be achieved by the use of a standardized encoder and decoder structure, such an approach is inflexible and will tend to result in suboptimal performance.

Hence, an improved system would be advantageous and in particular a system allowing increased flexibility, reduced complexity and/or improved performance would be advantageous.

Accordingly, the Invention seeks to preferably mitigate, alleviate or eliminate one or more of the above mentioned disadvantages singly or in any combination.

According to a first aspect of the invention there is provided an apparatus for generating a number of output audio channels; the apparatus comprising: means for receiving a data stream comprising a number of input audio channels and parametric audio data; the data stream further comprising decoder tree structure data for a hierarchical decoder structure, the decoder tree structure data comprising at least one data value indicative of channel split characteristics for an audio channel at a hierarchical layer of the hierarchical decoder structure; means for generating the hierarchical decoder structure in response to the decoder tree structure data; and means for generating the number of output audio channels from the data stream using the hierarchical decoder structure.

The invention may allow a flexible generation of audio channels and may in particular allow a decoder functionality to adapt to an encoder structure used for generating the data stream. The invention may e.g. allow an encoder to select a suitable encoding approach for a multi-channel signal while allowing the apparatus to automatically adapt thereto. The invention may allow a data stream having an improved quality to bit-rate ratio. In particular, the invention may allow automatic adaptation and/or a high degree of flexibility while providing the improved audio quality achievable from hierarchical encoding/decoding structures. The invention may furthermore allow an efficient communication of information of the hierarchical decoder structure. Specifically, the invention may allow a low overhead for the decoder tree structure data. The invention may provide an apparatus which automatically adapts to the received bit-stream and which may be used with any suitable hierarchical encoding structure.

Each audio channel may support an individual audio signal. The data stream may be a single bit-stream or may e.g. be a combination of a plurality of sub-bit-stream for example distributed through different distribution channels. The data stream may have a limited duration such as a fixed duration corresponding to a data file of a given size. The channel split characteristic may be a characteristic indicative of how many channels a given audio channel is split into at a hierarchical layer. For example, the channel split characteristic may reflect if a given audio channel is not divided or whether it is divided into two audio channels.

The decoder tree structure data may comprise data for the hierarchical decoder structure of a plurality of audio channels. Specifically, the decoder tree structure data may comprise a set of data for each of the number of input audio channels. For example, the decoder tree structure data may comprise data for a decoder tree structure for each input signal.

According to an optional feature of the invention, the decoder tree structure data comprises a plurality of data values, each data value indicative of a channel split characteristic for one channel at one hierarchical layer of the hierarchical decoder structure.

This may provide for an efficient communication of data allowing the apparatus to adapt to the encoding used for the data stream. The decoder tree structure data may specifically comprise one data value for each channel split function in the hierarchical decoder structure. The decoder tree structure data may also comprise one data value for each output channel indicating that no further channel splits occur for a given hierarchical layer signal.

According to an optional feature of the invention, a predetermined data value is indicative of no channel split for the channel at the hierarchical layer.

This may provide for an efficient communication of data allowing the apparatus to effectively and reliably adapt to the encoding used for the data stream.

According to an optional feature of the invention, a predetermined data value is indicative of a one-to-two channel split for the channel at the hierarchical layer.

This may provide for an efficient communication of data allowing the apparatus to effectively and reliably adapt to the encoding used for the data stream. In particular, this may allow very efficient information transfer for many hierarchical systems using low complexity standard channel split functions.

According to an optional feature of the invention, the plurality of data values are binary data values.

This may provide for an efficient communication of data allowing the apparatus to effectively and reliably adapt to the encoding used for the data stream. In particular, this may allow very efficient information transfer for systems mainly using one specific channel split functionality, such as a one-to-two channel split functionality.

According to an optional feature of the invention, one predetermined binary data value is indicative of a one-to-two channel split and another predetermined binary data value is indicative of no channel split.

This may provide for an efficient communication of data allowing the apparatus to effectively and reliably adapt to the encoding used for the data stream. In particular, this may allow very efficient information transfer for systems based around a low complexity one-to-two channel split functionality. An efficient decoding may be achieved by a low complexity hierarchical decoder structure which may be generated in response to low complexity data. The feature may allow a low overhead for the communication of decoder tree structure data and may be particularly suited for data streams encoded by a simple encoding function.

According to an optional feature of the invention, the data stream further comprises an indication of the number of input channels.

This may facilitate the decoding and the generation of the decoding structure and/or may allow a more efficient encoding of information of the hierarchical decoder structure in the decoder tree structure data. In particular, the means for generating the hierarchical decoder structure may do so in response to the indication of the number of input channels. For example, in many practical situations the number of input channels can be derived from the data-stream), however in some special cases the audio and parameters data may be separated. In such cases it may be beneficial if the number of input channels is known as the data stream data might have been manipulated (e.g. downmixed from stereo to mono).

According to an optional feature of the invention, the data stream further comprises an indication of the number of output channels.

This may facilitate the decoding and the generation of the decoding structure and/or may allow a more efficient encoding of information of the hierarchical decoder structure in the decoder tree structure data. In particular, the means for generating the hierarchical decoder structure may do so in response to the indication of the number of output channels. Also, the indication may be used as an error check of the decoder tree structure data.

According to an optional feature of the invention, the data stream comprises an indication of a number of one-to-two channel split functions in the hierarchical decoder structure.

This may facilitate the decoding and the generation of the decoding structure and/or may allow a more efficient encoding of information of the hierarchical decoder structure in the decoder tree structure data. In particular, the means for generating the hierarchical decoder structure may do so in response to the indication of number of one-to-two channel split functions in the hierarchical decoder structure.

According to an optional feature of the invention, the data stream further comprises an indication of a number of two-to-three channel split functions in the hierarchical decoder structure.

This may facilitate the decoding and the generation of the decoding structure and/or may allow a more efficient encoding of information of the hierarchical decoder structure in the decoder tree structure data. In particular, the means for generating the hierarchical decoder structure may do so in response to the indication of the number of two-to-three channel split functions in the hierarchical decoder structure.

According to an optional feature of the invention, the decoder tree structure data comprises a data for a plurality of decoder tree structures ordered in response to the presence of a two-to-three channel split functionality.

This may facilitate the decoding and the generation of the decoding structure and/or may allow a more efficient encoding of information of the hierarchical decoder structure in the decoder tree structure data. In particular, the feature may allow advantageous performance in systems wherein two-to-three channel splits may only occur at the root layer. E.g. the means for generating the hierarchical decoder structure may first generate the two-to-three split functionality for two input channels followed by the generation of the remaining structure using only one-to-two channel split functionality. The remaining structure may specifically be generated in response to the binary decoder tree structure data thus reducing the required bit rate. The data stream may further contain information of the ordering of the plurality of decoder tree structures.

According to an optional feature of the invention, the decoder tree structure data for at least one input channel comprises an indication of a two-to-three channel split function being present at the root layer followed by binary data where each binary data value is indicative of either no split functionality or a one-to-two channel split functionality for dependent layers of the two-to-three split functionality.

This may facilitate the decoding and the generation of the decoding structure and/or may allow a more efficient encoding of information of the hierarchical decoder structure in the decoder tree structure data. In particular, the feature may allow advantageous performance in systems where two-to-three channel splits may only occur at the root layer. E.g. the means for generating the hierarchical decoder structure may first generate the two-to-three split functionality for an input channel followed by the generation of the remaining structure using only one-to-two channel split functionality. The remaining structure may specifically be generated in response to binary decoder tree structure data thus reducing the required bit rate.

According to an optional feature of the invention, the data stream comprises an indication of a loudspeaker position for at least one of the output channels.

This may allow facilitated decoding and may allow improved performance and/or adaptation of the apparatus thus providing increased flexibility.

According to an optional feature of the invention, the means for generating the hierarchical decoder structure is arranged to determine multiplication parameters for channel split functions of the hierarchical layers in response to the decoder tree structure data.

This may allow improved performance and/or an improved adaptation/flexibility. In particular, the feature may allow not only the hierarchical decoder structure but also the operation of the channel split functions to adapt to the received data stream. The multiplication parameters may be matrix multiplication parameters.

According to an optional feature of the invention, the decoder tree structure comprises at least one channel split functionality in at least one hierarchical layer, the at least one channel split functionality comprising: de-correlation means for generating a de-correlated signal directly from an audio input channel of the data stream; at least one channel split unit for generating a plurality of hierarchical layer output channels from an audio channel from a higher hierarchical layer and the de-correlated signal; and means for determining at least one characteristic of the de-correlation filter or the channel split unit in response to the decoder tree structure data.

This may allow improved performance and/or an improved adaptation/flexibility. In particular, the feature may allow a hierarchical decoder structure which has improved decoding performance and which may generate output channels having increased audio quality. In particular, a hierarchical decoder structure wherein no de-correlation signals are generated by cascaded de-correlation filters may be achieved and dynamically and automatically adapted to the received data stream.

The de-correlation filter receives the audio input channel of the data stream without modifications, and specifically without any prior filtering of the signal (such as by another de-correlation filter). The gain of the de-correlation filter may specifically be determined in response to the decoder tree structure data.

According to an optional feature of the invention, the de-correlation means comprises a level compensation means for performing an audio level compensation on the audio input channel to generate a level compensated audio signal; and a de-correlation filter for filtering the level compensated audio signal to generate the de-correlated signal.

This may allow improved quality and/or facilitated implementation.

According to an optional feature of the invention, the level compensation means comprises a matrix multiplication by a pre-matrix. This may allow an efficient implementation.

According to an optional feature of the invention, the coefficients of the pre-matrix have at least one unity value for a hierarchical decoder structure comprising only one-to-two channel split functionality.

This may reduce complexity and allow an efficient implementation. The hierarchical decoder structure may comprise other functionality than the one-to-two channel split functionality but will in accordance with this feature not comprise any other channel split functionality.

According to an optional feature of the invention, the apparatus further comprises means for determining the pre-matrix for the at least one channel split functionality in the at least one hierarchical layer in response to parameters of a channel split functionality in a higher hierarchical layer.

This may allow efficient implementation and/or improved performance. The channel split functionality in a higher hierarchical layer may include a two-to-three channel split functionality e.g. located at the root layer of a decoder tree structure.

According to an optional feature of the invention, the apparatus comprises means for determining a channel split matrix for the at least one channel split functionality in response to parameters of the at least one channel split functionality in the at least one hierarchical layer.

This may allow efficient implementation and/or improved performance. This may be particular advantageous for hierarchical decoder tree structures comprising only one-to-two channel split functionality.

According to an optional feature of the invention, the apparatus further comprises means for determining the pre-matrix for the at least one channel split functionality in the at least one hierarchical layer in response to parameters of a two-to-three up-mixer of a higher hierarchical layer.

This may allow efficient implementation and/or improved performance. This may be particular advantageous for hierarchical decoder tree structures comprising a two-to-three channel split functionality at the root layer of a decoder tree structure.

According to an optional feature of the invention, the means for determining the pre-matrix is arranged to determine the pre-matrix for the at least one channel split functionality in response to determine a first sub-pre-matrix corresponding to a first input of the two-to-three up-mixer and a second sub-pre-matrix corresponding to a second input of the two-to-three up-mixer.

This may allow efficient implementation and/or improved performance. This may be particularly advantageous for hierarchical decoder tree structures comprising a two-to-three channel split functionality at the root layer of a decoder tree structure.

According to another aspect of the invention, there is provided an apparatus for generating a data stream comprising a number output audio channels, the apparatus comprising: means for receiving a number of input audio channels; hierarchical encoding means for parametrically encoding the number of input audio channels to generate the data stream comprising the number of output audio channels and parametric audio data; means for determining a hierarchical decoder structure corresponding to the hierarchical encoding means; and means for including decoder tree structure data comprising at least one data value indicative of a channel split characteristic for an audio channel at a hierarchical layer of the hierarchical decoder structure in the data stream.

According to another aspect of the invention, there is provided a data stream comprising: a number of encoded audio channels; parametric audio data; and decoder tree structure data for a hierarchical decoder structure, the decoder tree structure data comprising at least one data value indicative of channel split characteristics for audio channels at hierarchical layers of the hierarchical decoder structure.

According to another aspect of the invention, there is provided a storage medium having stored thereon a signal as described above.

According to another aspect of the invention, there is provided a method of generating a number of output audio channels; the method comprising: receiving a data stream comprising a number of input audio channels and parametric audio data; the data stream further comprising decoder tree structure data for a hierarchical decoder structure, the decoder tree structure data comprising at least on data value indicative of channel split characteristics for an audio channel at a hierarchical layer of the hierarchical decoder structure; generating the hierarchical decoder structure in response to the decoder tree structure data; and generating the number of output audio channels from the data stream using the hierarchical decoder structure.

According to another aspect of the invention, there is provided a method of generating a data stream comprising a number of output audio channels, the method comprising: receiving a number of input audio channels; hierarchical encoding means parametrically encoding the number of input audio channels to generate the data stream comprising the number of output audio channels and parametric audio data; determining a hierarchical decoder structure corresponding to the hierarchical encoding means; and including decoder tree structure data comprising at least one data value indicative of a channel split characteristic for an audio channel at a hierarchical layer of the hierarchical decoder structure in the data stream.

According to another aspect of the invention, there is provided receiver for generating a number of output audio channels; the receiver comprising: means for receiving a data stream comprising a number of input audio channels and parametric audio data; the data stream further comprising decoder tree structure data for a hierarchical decoder structure, the decoder tree structure data comprising at least on data value indicative of channel split characteristics for an audio channel at a hierarchical layer of the hierarchical decoder structure; means for generating the hierarchical decoder structure in response to the decoder tree structure data; and means for generating the number of output audio channels from the data stream using the hierarchical decoder structure.

According to another aspect of the invention, there is provided transmitter for generating a data stream comprising a number of output audio channels, the transmitter comprising: means for receiving a number of input audio channels; hierarchical encoding means for parametrically encoding the number of input audio channels to generate the data stream comprising the number of output audio channels and parametric audio data; means for determining a hierarchical decoder structure corresponding to the hierarchical encoding means; and means for including decoder tree structure data comprising at least one data value indicative of a channel split characteristic for an audio channel at a hierarchical layer of the hierarchical decoder structure in the data stream.

According to another aspect of the invention, there is provided transmission system comprising a transmitter for generating a data stream and a receiver for generating a number of output audio channels; wherein the transmitter comprises: means for receiving a number of input audio channels, hierarchical encoding means for parametrically encoding the number of input audio channels to generate the data stream comprising the number of audio channels and parametric audio data, means for determining a hierarchical decoder structure corresponding to the hierarchical encoding means, means for including decoder tree structure data comprising at least one data value indicative of a channel split characteristic for an audio channel at a hierarchical layer of the hierarchical decoder structure in the data stream, and means for transmitting the data stream to the receiver; and the receiver comprises: means for receiving the data stream, means for generating the hierarchical decoder structure in response to the decoder tree structure data, and means for generating the number of output audio channels from the data stream using the hierarchical decoder structure.

According to another aspect of the invention, there is provided method of receiving a data stream; the method comprising: receiving a data stream comprising a number of input audio channels and parametric audio data; the data stream further comprising decoder tree structure data for a hierarchical decoder structure, the decoder tree structure data comprising at least on data value indicative of channel split characteristics for an audio channel at a hierarchical layer of the hierarchical decoder structure; generating the hierarchical decoder structure in response to the decoder tree structure data; and generating the number of output audio channels from the data stream using the hierarchical decoder structure.

According to another aspect of the invention, there is provided method of transmitting a data stream comprising a number of output audio channels, the method comprising: receiving a number of input audio channels; parametrically encoding the number of input audio channels to generate the data stream comprising the number of output audio channels and parametric audio data; determining a hierarchical decoder structure corresponding to the hierarchical encoding means; including decoder tree structure data comprising at least one data value indicative of a channel split characteristic for an audio channel at a hierarchical layer of the hierarchical decoder structure in the data stream; and transmitting the data stream.

According to another aspect of the invention, there is provided method of transmitting and receiving a data stream, the method comprising: at a transmitter: receiving a number of input audio channels, parametrically encoding the number of input audio channels to generate the data stream comprising the number of audio channels and parametric audio data, determining a hierarchical decoder structure corresponding to the hierarchical encoding means, including decoder tree structure data comprising at least one data value indicative of a channel split characteristic for an audio channel at a hierarchical layer of the hierarchical decoder structure in the data stream, and transmitting the data stream to the receiver; and at a receiver: receiving the data stream, generating the hierarchical decoder structure in response to the decoder tree structure data, and generating the number of output audio channels from the data stream using the hierarchical decoder structure.

According to another aspect of the invention, there is provided computer program product for executing any of the methods described above.

According to another aspect of the invention, there is provided an audio playing device comprising an apparatus as described above.

According to another aspect of the invention, there is provided an audio recording device comprising an apparatus as described above.

These and other aspects, features and advantages of the invention will be apparent from and elucidated with reference to the embodiment(s) described hereinafter.

Embodiments of the invention will be described, by way of example only, with reference to the drawings, in which.

The following description focuses on embodiments of the invention applicable to encoding and decoding of a multi channel audio signal using a number of low complexity channel down-mixers and up-mixers. However, it will be appreciated that the invention is not limited to this application. It will be understood by the person skilled in the art that a down-mixer is arranged to combine a number of audio channels into a lower number of audio channels and additional parametric data, and that an up-mixer is arranged to generate a number of audio channels from a lower number of audio channels and parametric data. Thus, an up-mixer provides a channel split functionality.

Figure 1:
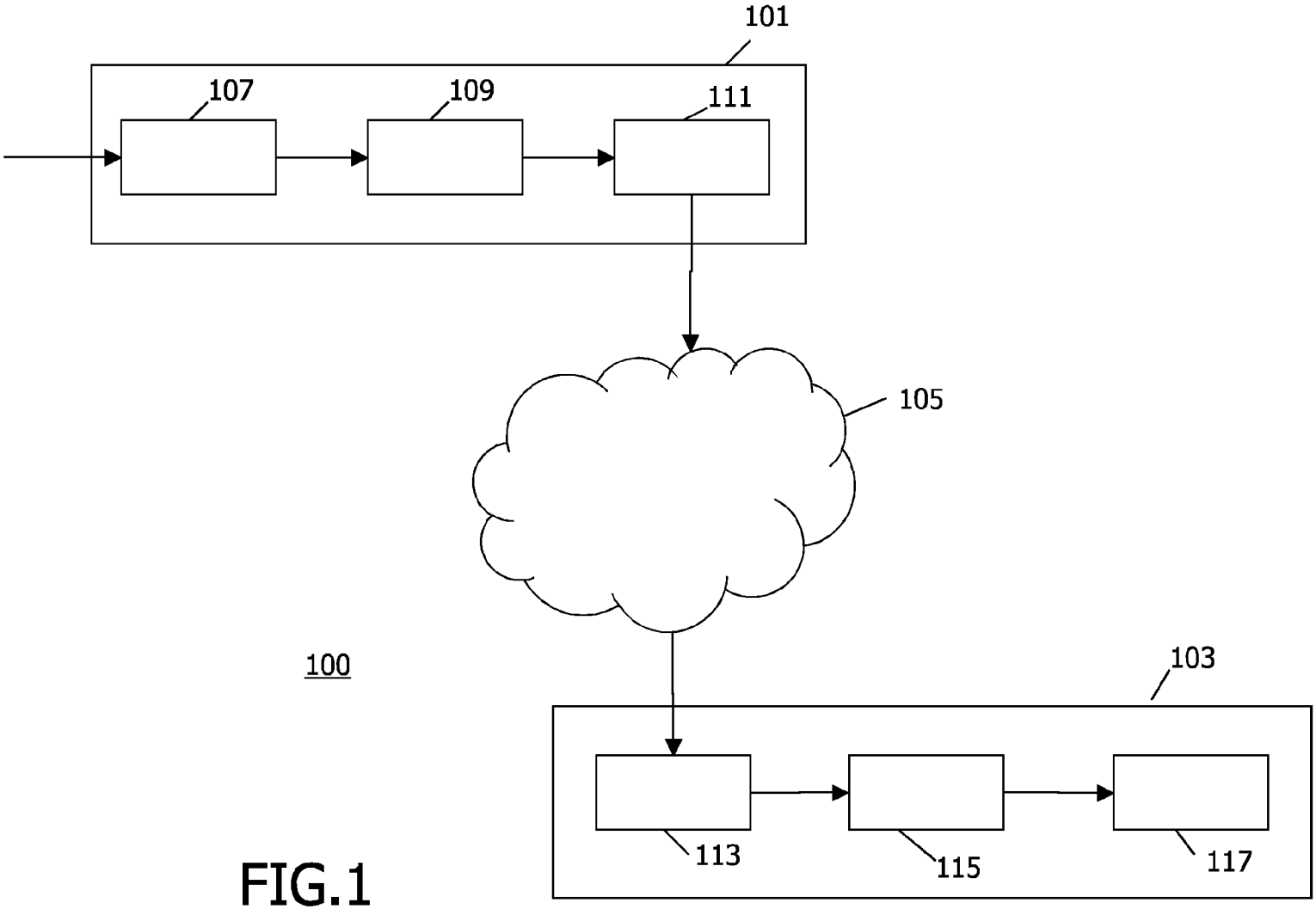
FIG. 1 illustrates a transmission system for communication of an audio signal in accordance with some embodiments of the invention.

FIG. 1 illustrates a transmission system 100 for communication of an audio signal in accordance with some embodiments of the invention. The transmission system 100 comprises a transmitter 101 which is coupled to a receiver 103 through a network 105 which specifically may be the Internet.

In the specific example, the transmitter 101 is a signal recording device and the receiver is a signal player device 103 but it will be appreciated that in other embodiments a transmitter and receiver may used in other applications and for other purposes. For example, the transmitter 101 and/or the receiver 103 may be part of a transcoding functionality and may e.g. provide interfacing to other signal sources or destinations.

In the specific example where a signal recording function is supported, the transmitter 101 comprises a digitizer 107 which receives an analog signal that is converted to a digital PCM signal by sampling and analog-to-digital conversion.

The transmitter 101 is coupled to the encoder 109 of FIG. 1 which encodes the PCM signal in accordance with an encoding algorithm. The encoder 100 is coupled to a network transmitter 111 which receives the encoded signal and interfaces to the Internet 105. The network transmitter may transmit the encoded signal to the receiver 103 through the Internet 105.

The receiver 103 comprises a network receiver 113 which interfaces to the Internet 105 and which is arranged to receive the encoded signal from the transmitter 101.

The network receiver 111 is coupled to a decoder 115. The decoder 115 receives the encoded signal and decodes it in accordance with a decoding algorithm.

In the specific example where a signal playing function is supported, the receiver 103 further comprises a signal player 117 which receives the decoded audio signal from the decoder 115 and presents this to the user. Specifically, the signal player 113 may comprise a digital-to-analog converter, amplifiers and speakers as required for outputting the decoded audio signal.

In the example of FIG. 1, the encoder 109 and decoder 115 use a cascaded or tree-based structure consisting of small building blocks. The encoder 109 thus uses a hierarchical encoding structure wherein the audio channels are progressively processed in different layers of the hierarchical structure. Such a structure may lead to a particularly advantageous encoding with high audio quality yet relatively low complexity and easy implementation of the encoder 109.

Figure 2:
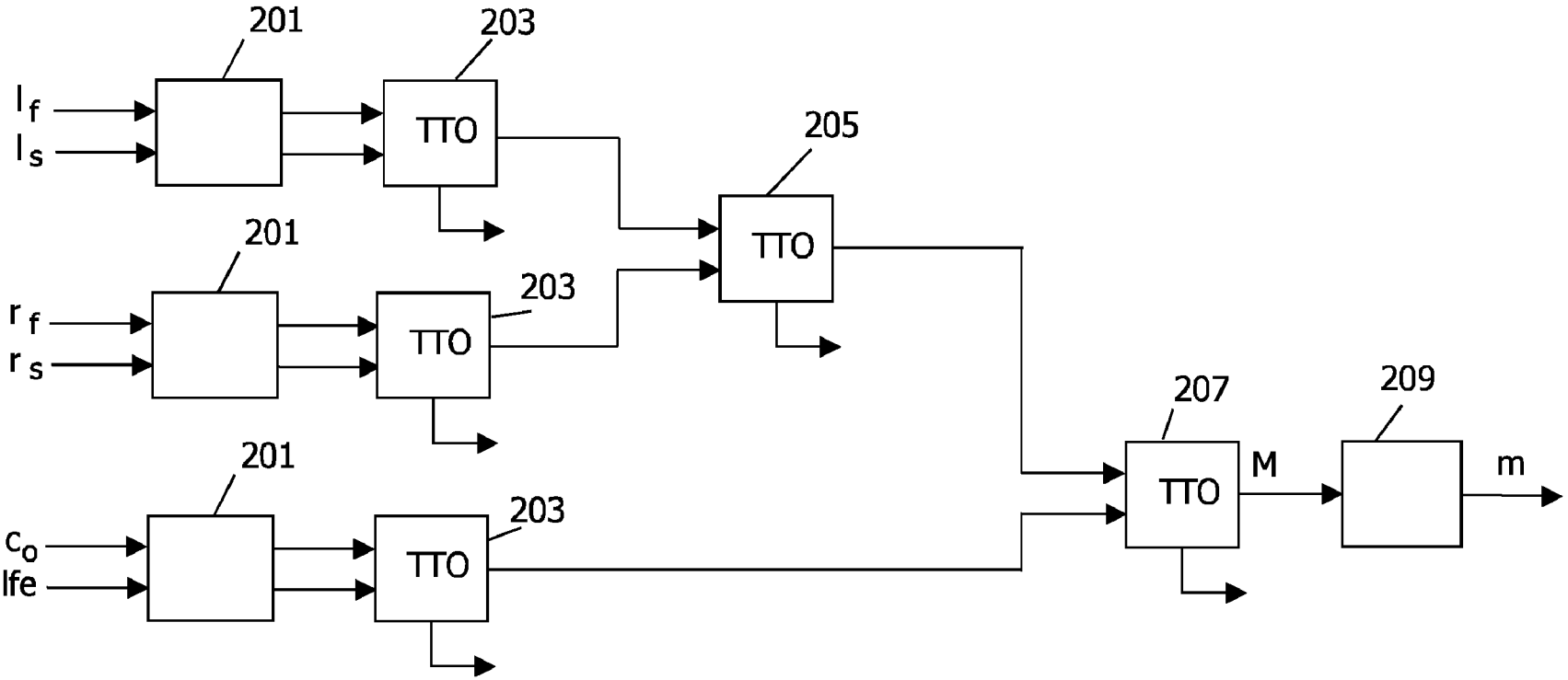
FIG. 2 illustrates an example of a hierarchical encoder structure that may be employed in some embodiments of the invention.

FIG. 2 illustrates an example of a hierarchical encoder structure that may be employed in some embodiments of the invention.

In the example, the encoder 109 encodes a 5.1 channel surround sound input signal consisting of a left front ($l_f$), left surround ($l_s$), right front ($r_f$), right surround, center ($c_0$) and a subwoofer or Low Frequency Enhancement (lfe) channel. The channels are first segmented and transformed to the frequency domain in the segmentation blocks 201. The resulting frequency domain signals are fed pair wise to Two-To-One (TTO) down-mixers 203 which down-mix two input signals into a single output channel and extract the corresponding parameters. Thus, the three TTO down-mixers 203 down-mix the six input channels to three audio channels and parameters.

As illustrated in FIG. 2, the output of the TTO down-mixers 203 are used as input for other TTO down-mixers 205, 207. Specifically, two of the TTO down-mixers 203 are coupled to a fourth TTO down-mixer 205 which combines the corresponding channels into a single channel. The third of the TTO down-mixers 203 is together with the fourth TTO down-mixer 205 coupled to a fifth TTO down-mixer 207 which combines the remaining two channels into a single channel (M). This signal is finally transformed back to the time domain resulting in an encoded multi-channel audio bitstream m.

The TTO down-mixers 203 may be considered to comprise the first layer of the encoding structure, with a second layer comprising the fourth TTO down-mixer 205 and the third layer comprising the fifth TTO down-mixer 207. Thus, a combination of a number of audio channels into a lower number of audio channels is taking place in each layer of the hierarchical encoder structure.

The hierarchical encoding structure of the encoder 109 may result in very efficient and high quality encoding for low complexity. Furthermore, the hierarchical encoding structure may be varied depending on the nature of the signal which is encoded. For example, if a simple stereo signal is encoded, this may be achieved by a hierarchical encoding structure comprising only a single TTO down-mixer and a single layer.

In order for the decoder 115 to handle signals encoded using different hierarchical encoding structures, it must be able to adapt to the hierarchical encoding structure used for the specific signal. Specifically, the decoder 115 comprises functionality for configuring itself to have a hierarchical decoder structure that matches the hierarchical encoding structure of the encoder 109. However, in order to do so, the decoder 115 must be provided with information of the hierarchical encoding structure used for encoding the received bitstream.

Figure 3:
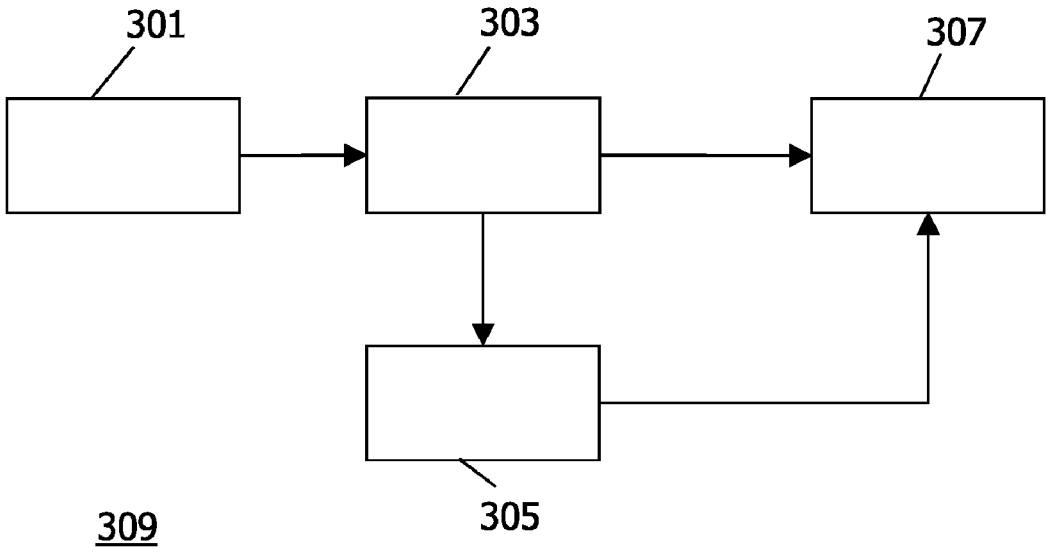
FIG. 3 illustrates an example of an encoder in accordance with some embodiments of the invention.

FIG. 3 illustrates an example of the encoder 109 in accordance with some embodiments of the invention.

The encoder 109 comprises a receive processor 301 which receives a number of input audio channels. For the specific example of FIG. 2, the encoder 109 receives six input channels. The receive processor 301 is coupled to an encode processor 303 which has a hierarchical encoding structure. As an example, the hierarchical encoding structure of the encode processor 303 may correspond to that illustrated in FIG. 2.

The encode processor 303 is furthermore coupled to an encoding structure processor 305 which is arranged to determine the hierarchical encoding structure used by the encode processor 303. The encode processor 303 may specifically feed structure data to the encoding structure processor 305. In response, the encoding structure processor 305 generates decoder tree structure data which is indicative of the hierarchical decoder structure that must be used by the decoder to decode the encoded signal generated by the encode processor 303.

It will be appreciated, that the decoder tree structure data may directly be determined as data describing the hierarchical encoding structure or may e.g. be data which directly describes the hierarchical decoder structure that must be used (e.g. it may describe the complementary structure to that of the encode processor 303).

The decoder tree structure data specifically comprises at least one data value indicative of a channel split characteristic for an audio channel at hierarchical layers of the hierarchical decoder structure. Thus, the decoder tree structure data may comprise at least one indication of where an audio channel must be split in the decoder. Such an indication may for example be an indication of a layer in which the encoding structure comprises a down-mixer or may equivalently be an indication of a layer of the decoder tree structure that must comprise an up-mixer.

The encode processor 303 and the encoding structure processor 305 are coupled to a data stream generator 307 which generates a bit stream comprising the encoded audio from the encode processor 303 and the decoder tree structure data from the encoding structure processor 305. This data stream is then fed to the network transmitter 111 for communication to the receiver 103.

Figure 4:
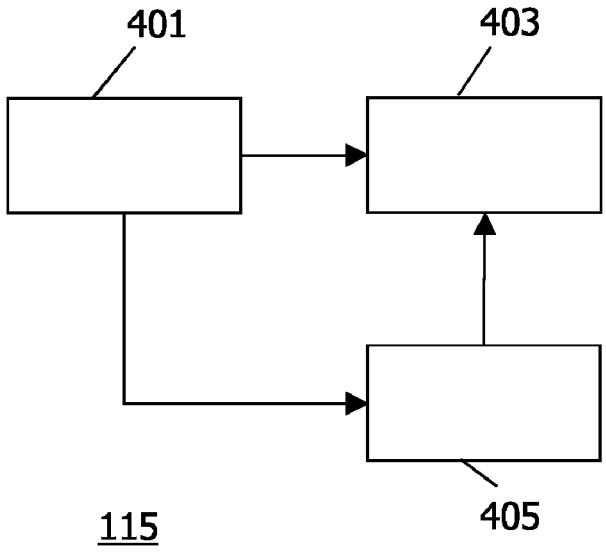
FIG. 4 illustrates an example of a decoder in accordance with some embodiments of the invention.

FIG. 4 illustrates an example of the decoder 115 in accordance with some embodiments of the invention.

The decoder 115 comprises a receiver 401 which receives the data stream transmitted from the network receiver 113. The decoder 115 furthermore comprises a decode processor 403 and a decoder structure processor 405 coupled to the receiver 401.

The receiver 401 extracts the decoder tree structure data and feeds this to the decoder structure processor 405 whereas the audio encoding data comprising a number of audio channels and the parametric audio data is fed to the decode processor 403.

The decoder structure processor 405 is arranged to determine the hierarchical decoder structure in response to the received decoder tree structure data. Specifically, the decoder structure processor 405 may extract the data values specifying the data splits and may generate information of the hierarchical decoder structure that complements the hierarchical encoding structure of the encode processor 303. This information is fed to the decode processor 403 causing this to be configured for the specified hierarchical decoder structure.

Subsequently, the decoder structure processor 405 proceeds to generate the output channels corresponding to the original inputs to the encoder 109 using the hierarchical decoder structure.

Thus, the system may allow an efficient and high quality encoding, decoding and distribution of audio signals and specifically of multi-channel audio signals. A very flexible system is enabled wherein decoders may automatically adapt to the encoders and the same decoders may thus be used with a number of different encoders.

The decoder tree structure data is effectively communicated using data values which are indicative of channel split characteristics for the audio channels at the different hierarchical layers of the hierarchical decoder structure. Thus, the decoder tree structure data is optimized for flexible and high performance hierarchical encoding and decoding structures.

For example, a 5.1 channel signal (i.e. a six channel signal) may be encoded as a stereo signal plus a set of spatial parameters. Such encoding can be achieved by many different hierarchical encoding structures that use simple TTO or Three-To-Two (TTT) down-mixers and thus many different hierarchical decoder structures are possible using One-To-Two (OTT) or Two-To-Three (TTT) up-mixers. Thus, in order to decode the corresponding spatial bit stream, the decoder should have knowledge of the hierarchical encoding structure that has been employed in the encoder. One straightforward approach is then to signal the tree in the bit-stream by means of an index into a look-up table. An example of suitable look-up table may be:

| Tree codeword | Tree |
|---|---|
| 0 . . . 000 | Mono to 5.1 variant A |
| 0 . . . 001 | Mono to 5.1 variant B |
| 0 . . . 010 | Stereo to 5.1 variant A |
| . . . | . . . |
| 1 . . . 111 | . . . |

However, using such a look-up table has the disadvantage that all hierarchical encoding structures which possibly may be used must be explicitly specified in the look-up table. However, this requires that all decoders/encoders must receive updated look-up tables in order to introduce a new hierarchical encoding structure to the system. This is highly undesirable and results in complex operation and an inflexible system.

In contrast, the use of decoder tree structure data where data values indicate channel splits at the different layers of the hierarchical decoder structure allows a simple general communication of the decoder tree structure data which may describe any hierarchical decoder structure. Thus, new encoding structures may readily be used without requiring any prior notification of the corresponding decoders.

Thus, in contrast to the look-up based approach, the system of FIG. 1 can handle an arbitrary number of input and output channels while maintaining full flexibility. This is achieved by specifying a description of the encoder/decoder tree in the bit-stream. From this description the decoder can derive where and how to apply the subsequent parameters encoded in the bit stream.

The decoder tree structure data may specifically comprise a plurality of data values where each data value is indicative of a channel split characteristic for one channel at one hierarchical layer of the hierarchical decoder structure. Specifically, the decoder tree structure data may comprise one data value for each up-mixer to be included in the hierarchical decoder structure. Furthermore, one data value may be included for each channel which is not to be split further. Thus, if a data value of the decoder tree structure data has a value corresponding to one specific predetermined data value this may indicate that the corresponding channel is not to be split further but is in fact an output channel of the decoder 115.

In some embodiments, the system may only incorporate encoders which exclusively use TTO down-mixers and the decoder may accordingly be implemented using only OTT up-mixers. In such an embodiment, a data value may be included for each channel of the decoder. Furthermore, the data value may take on one of two possible values with one value indicating that the channel is not split and the other value indicating that the channel is split into two channels by an OTT up-mixer. Furthermore, the order of the data values in the decoder tree structure data may indicate which channels are split and thus the location of the OTT up-mixers in the hierarchical decoder structure. Thus, a decoder tree structure data comprising simple binary values completely describing the required hierarchical decoder structure may be achieved.

As a specific example, the derivation of a bitstring description of the hierarchical decoder structure of the decoder of FIG. 5 will be described.

In the example, it is assumed that encoders may only use TTO down-mixers and thus the decoder tree may be described by a binary string. In the example of FIG. 5, a single input audio channel is expanded to a five channel output signal using OTT up-mixers. In the example, four layers of depth can be discerned, the first, denoted with 0, is at the layer of the input signal, the last, denoted with 3, is at the layer of the output signals. It will be appreciated that in this description the layers are characterized by the audio channels with the up-mixers forming the layer boundaries, the layers may equivalently be considered to comprise or be formed by the up-mixers.

Figure 5:
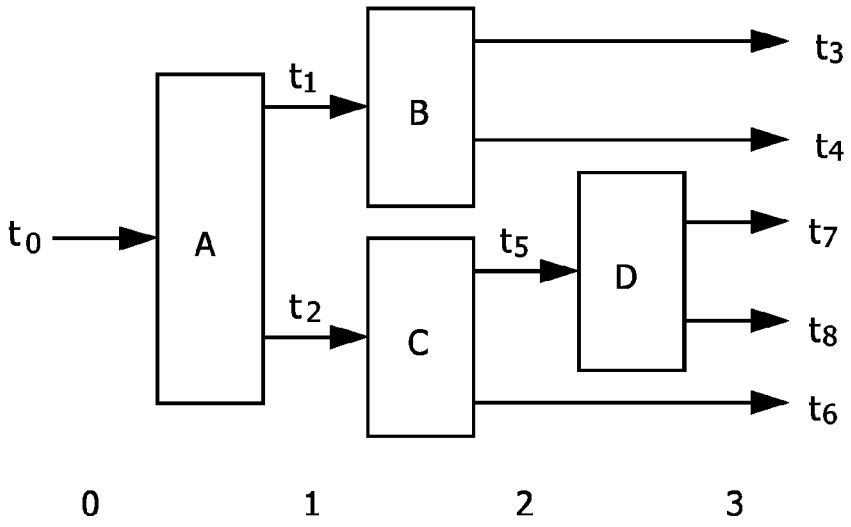
FIG. 5 illustrates an example of some hierarchical decoder structures that may be employed in some embodiments of the invention.

In the example, the hierarchical decoder structure of FIG. 5 may be described by the bit string "111001000" derived by the following steps:

1—The input signal at layer 0, $t_0$, is split (OTT up-mixer A), as a result all signal at layer 0 are accounted for, move on to layer 1.

1—The first signal at layer 1 (coming out of the top of OTT up-mixer A) is split (OTT up-mixer B).

1—The second signal at layer 1 (coming out of the bottom of OTT up-mixer A) is split (OTT up-mixer C), all signals at layer 1 are described, move on to layer 2.

0—The first signal at layer 2 (top of OTT up-mixer B) is not split any further.

0—The second signal at layer 2 (bottom of OTT up-mixer B) is not split any further.

1—The third signal at layer 2 (top of OTT up-mixer C) is again split.

0—The fourth signal at layer 2 (bottom of OTT up-mixer D) is not split any further, all signals at layer 2 are described, move on to layer 3.

0—The first signal at layer 3 (top of OTT up-mixer D) is not split any further 0—The second signal at layer 3 (bottom of OTT up-mixer D) is not split any further, all signals have been described.

In some embodiments, the encoding may be limited to using only TTO and TTT down-mixers and thus the decoding may be limited to using only OTT and TTT up-mixers. Although, the TTT up-mixers may be used in many different configurations, it is particularly advantageous to use them in a mode where (waveform) prediction is used to accurately estimate the three output signals from the two input signals. Due to this predictive nature of the TTT up-mixers, the logical position for these up-mixers is at the root of the tree. This is a consequence of the OTT up-mixers destroying the original waveform thereby making prediction unsuitable. Thus, in some embodiments, the only up-mixers that are used in the decoder structure are OTT up-mixers or TTT up-mixers in the root layer.

Hence, for such systems, three different situations can be discerned which together allow for a universal tree description:

1) Trees that have a TTT up-mixer as root.

2) Trees consisting only of OTT up-mixers.

3) "Empty trees", i.e., a direct mapping from input to output channel(s).

Figure 6:
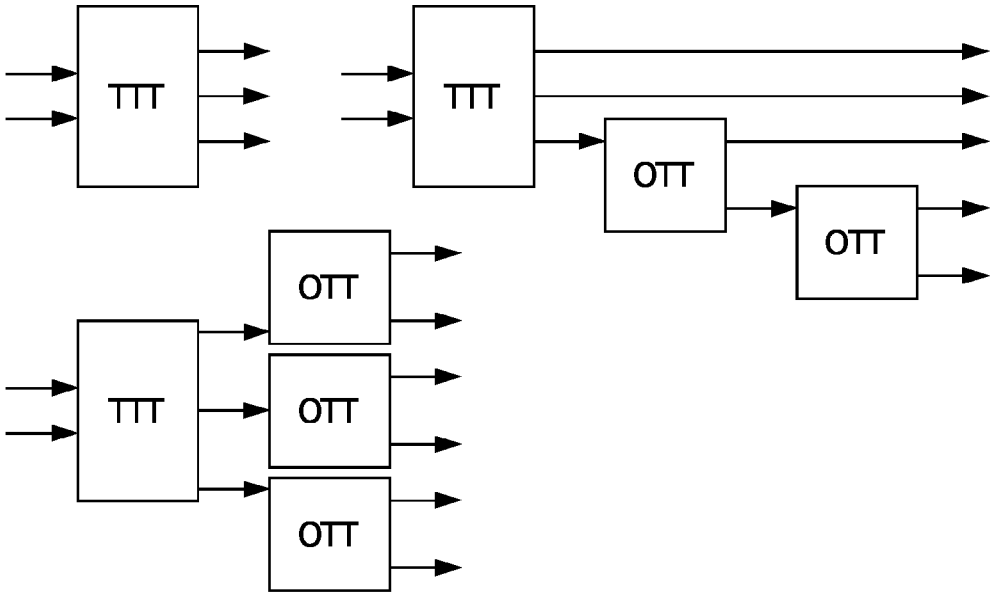
FIG. 6 illustrates example hierarchical decoder structures having two-to-three up-mixers at the root.
Figure 7:
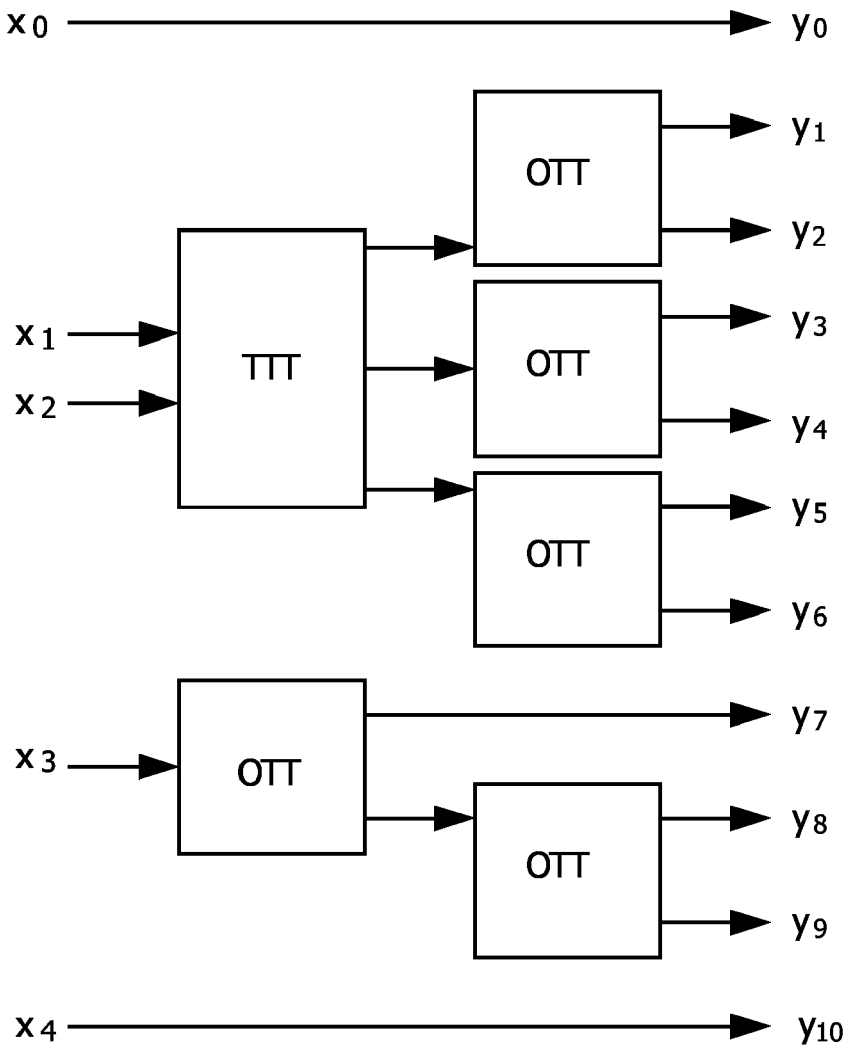
FIG. 7 illustrates an example hierarchical decoder structure comprising a plurality of decoder tree structures.

FIG. 6 illustrates example hierarchical decoder structures having TTT up-mixers at the root and FIG. 7 illustrates an example hierarchical decoder structure comprising a plurality of decoder tree structures. The hierarchical decoder structure of FIG. 7 comprises decoder tree structures according to all three examples presented above.

In some embodiments, the decoder tree structure data is ordered in order of whether an input channel comprises a TTT up-mixer or does not. The decoder tree structure data may comprise an indication of a TTT up-mixer being present at the root layer followed by binary data indicative of whether the channels of the lower layers are split by a OTT up-mixer or are not split further. This may improve performance in terms of bit-rate and low signaling costs.

For example, the decoder tree structure data may indicate how many TTT up-mixers are included in the hierarchical decoder structure. As each tree structure may only comprise one TTT up-mixer which is located at the root level, the remainder of the tree may be described by a binary string as described previously (i.e. as the tree is a OTT up-mixer tree only for lower layers, the same approach as described for an OTT up-mixer only hierarchical decoder structure can be applied).

Also, the remaining tree structures are either OTT up-mixer only trees or empty trees which can also be described by binary strings. Thus, all trees can be described by binary data values and the interpretation of the binary string may depend on which category the tree belongs to. This information may be provided by the location of the tree in the decoder tree structure data. For example, all trees comprising a TTT up-mixer may be located first in the decoder tree structure data, followed by the OTT up-mixer only trees, followed by the empty trees. If the number of TTT up-mixers and OTT up-mixers in the hierarchical decoder structure is included in the decoder tree structure data, the decoder can be configured without requiring any further data. Thus, a highly efficient communication of information of the required decoder structure is achieved. The overhead of communicating the decoder tree structure data may be kept very low, yet a highly flexible system is provided which may describe a wide variety of hierarchical decoder structures.

As a specific example, the hierarchical decoder structures of the decoder of FIG. 7 may be derived from decoder tree structure data by the following process:

The number of input signals is derived from the (possibly encoded) down-mix.

The number of OTT up-mixers and TTT up-mixers of the whole tree are signaled in the decoder tree structure data and may be extracted therefrom. The number of output signals can be derived as: #output signals=#input signals+#TTT up-mixers+#OTT up-mixers.

The input channels may be remapped in the decoder tree structure data such that after remapping first the trees according to situation 1) are encountered, followed by the trees according to situation 2) and then 3). For the example of FIG. 7 this would result in the order 3, 0, 1, 2, 4, i.e., signal 0 is signal 3 after remapping, signal 1 is signal 0 after remapping, etc.

For each TTT up-mixer, three OTT-only tree descriptions are given using the method described above, one OTT-only tree per TTT output channel.

For all remaining input signals OTT-only descriptions are given.

In some embodiments, an indication of a loudspeaker position for the output channels is included in the decoder tree structure data. For example, a look-up table of predetermined loudspeaker locations may be used, such as for example:

| Bit string | (Virtual) loudspeaker position |
|---|---|
| 0 . . . 000 | Left (front) |
| 0 . . . 001 | Right (front) |
| 0 . . . 010 | Center |
| 0 . . . 011 | LFE |
| 0 . . . 100 | Left surround |
| 0 . . . 101 | Right surround |
| 0 . . . 110 | Center surround |
| . . . | . . . |

Alternatively, the loudspeaker locations can be represented using a hierarchical approach. E.g. a few first bits specify the x-axis, e.g. L, R, C, then another few bits specify the y-axis, e.g. Front, Side, Surround and another few bits specify the z-axis (elevation).

As a specific example, the following provides an exemplary bit stream syntax for a bit-stream following the described guidelines above. In the example, the number of input and output signals is explicitly coded in the bit-stream. Such information can be used to validate part of the bit-stream.

```
Syntax
TreeDescription( )
{
        numInChan = bsNumInChan+1;
        numOutChan = bsNumOutChan+2;
        numTttUp_mixers = bsNumTttUp_mixers;
        numOttUp_mixers = bsNumOttUp_mixers;
        For (ch=0; ch< numInChan; ch++) {
            bsChannelRemapping[ch]
        }
        For (ch=0; ch< numOutChan; ch++) {
            bsOutputChannelPos[ch]
        }
        Idx = 0;
        ottUp_mixerIdx = 0;
        For (i=0; i< numTttUp_mixers; i++) {
            TttConfig(i);
            for (ch=0; ch<3; ch++, idx++) {
                OttTreeDescription(idx);
            }
        }
        while (ottUp-mixerIdx < numOttUp_mixersidx < numInChan +
numTttUp_mixers) {
            OttTreeDescription(idx);
            idx++;
        }
        numOttUp_mixers = ottUp_mixerIdx + 1;
}
```

In this example, each OttTree is handled in the OttTreeDescription( ) which is illustrated below.

```
Syntax
OttTreeDescription(idx)
{
        CurrLayerSignals = 1
        NextLayerSignals = 0
        while (CurrLayerSignals>0) {
            bsOttUp_mixerPresent
            if (bsOttUp_mixerPresent == 1) {
                OttConfig(ottUp_mixerIdx);
                ottDefaultCld[ottUp_mixerIdx] =
bsOttDefaultCld[ottUp_mixerIdx];
                ottModeLfe[ottUp_mixerIdx] =
bsOttModeLfe[ottUp_mixerIdx];
                NextLayerSignals += 2;
                ottUp_mixerIdx ++;
            }
            CurrLayerSignals--;
            if ((CurrLayerSignals == 0) &&
(NextLayerSignals>0)) {
                CurrLayerSignals = NextLayerSignals;
                NextLayerSignals = 0;
            }
        }
}
```

In the above syntax bold formatting is used to indicate elements read from the bit stream.

It will be appreciated that the notion of hierarchical layers is not needed in such a description. For example a description based on a principle of "as long as there are open ends, there are more bits to come" could also be applied. In order to decode the data, this notion may become useful however.

Apart from the single bits denoting whether or not an OTT up-mixer is present, the following data is included for the OTT up-mixer:

The default Channel Level Difference.

Whether the OTT up-mixer is an LFE (Low Frequency Enhancement) OTT up-mixer, i.e., whether the parameters are only band-limited and do not contain any correlation/coherence data.

Additionally, data may specify specific properties of the up-mixers, such as in the example of the TTT up-mixer, which mode to use (waveform based prediction, energy based description, etc.).

Figure 8:
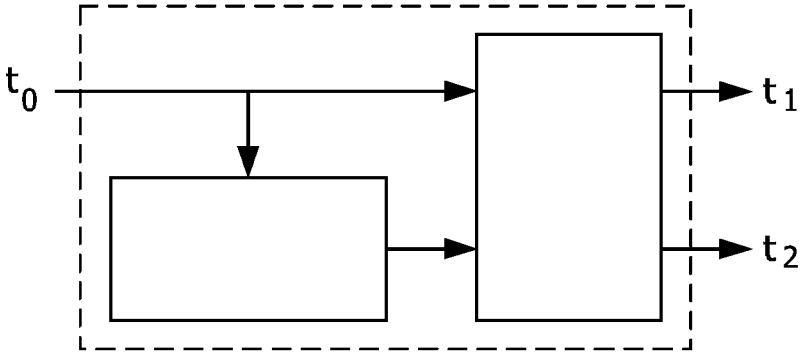
FIG. 8 illustrates an example of a one-to-two up-mixer.

As will be known to a person skilled in the art, an OTT up-mixer uses a de-correlated signal to split a single channel into two channels. Furthermore, the de-correlated signal is derived from the single input channel signal. FIG. 8 illustrates an example of an OTT up-mixer according to this approach. Thus, the exemplary decoder of FIG. 5 may be represented by the diagram of FIG. 9 wherein the de-correlator blocks generating the de-correlated signals are explicitly shown.

However, as can be seen, this approach leads to a cascading of de-correlator blocks such that the de-correlated signal for a lower layer OTT up-mixer is generated from an input signal which has been generated from another de-correlated signal. Thus, rather than being generated from the original input signal at the root level, the de-correlated signals of the lower layers will have been processed by several de-correlation blocks. As each de-correlation block comprises a de-correlation filter, this approach may result in a "smearing" of the de-correlated signal (for example transients may be significantly distorted). This results in audio quality degradation for the output signal.

Thus, in order to improve the audio quality, the de-correlators applied in the decoder up-mix may therefore in some embodiments be moved such that a cascading of de-correlated signals is prevented. FIG. 10 illustrates an example of a decoder structure corresponding to that of FIG. 9 but with the de-correlators directly coupled to the input channel. Thus, instead of taking the output of the predecessor OTT up-mixer as input to the de-correlator, the de-correlator up-mixers directly take the original input signal to, pre-processed by the gain up-mixers $G_B$, $G_C$ and $G_D$. These gains ensure that the power at the input of the de-correlator is identical to the power that would have been achieved at the input of the de-correlator in the structure of FIG. 9. The structure obtained in this way doesn't contain a cascade of de-correlators thereby resulting in improved audio quality.

In the following, an example of how to determine matrix multiplication parameters for the up-mixers of the hierarchical layers in response to the decoder tree structure data will be described. Particularly, the description will focus on embodiments wherein the de-correlation filters for generating the de-correlated signals of the up-mixers are connected directly to the audio input channels of the decoding structure. Thus, the description will focus on embodiments of encoders such as that illustrated in FIG. 10.

Figure 11:
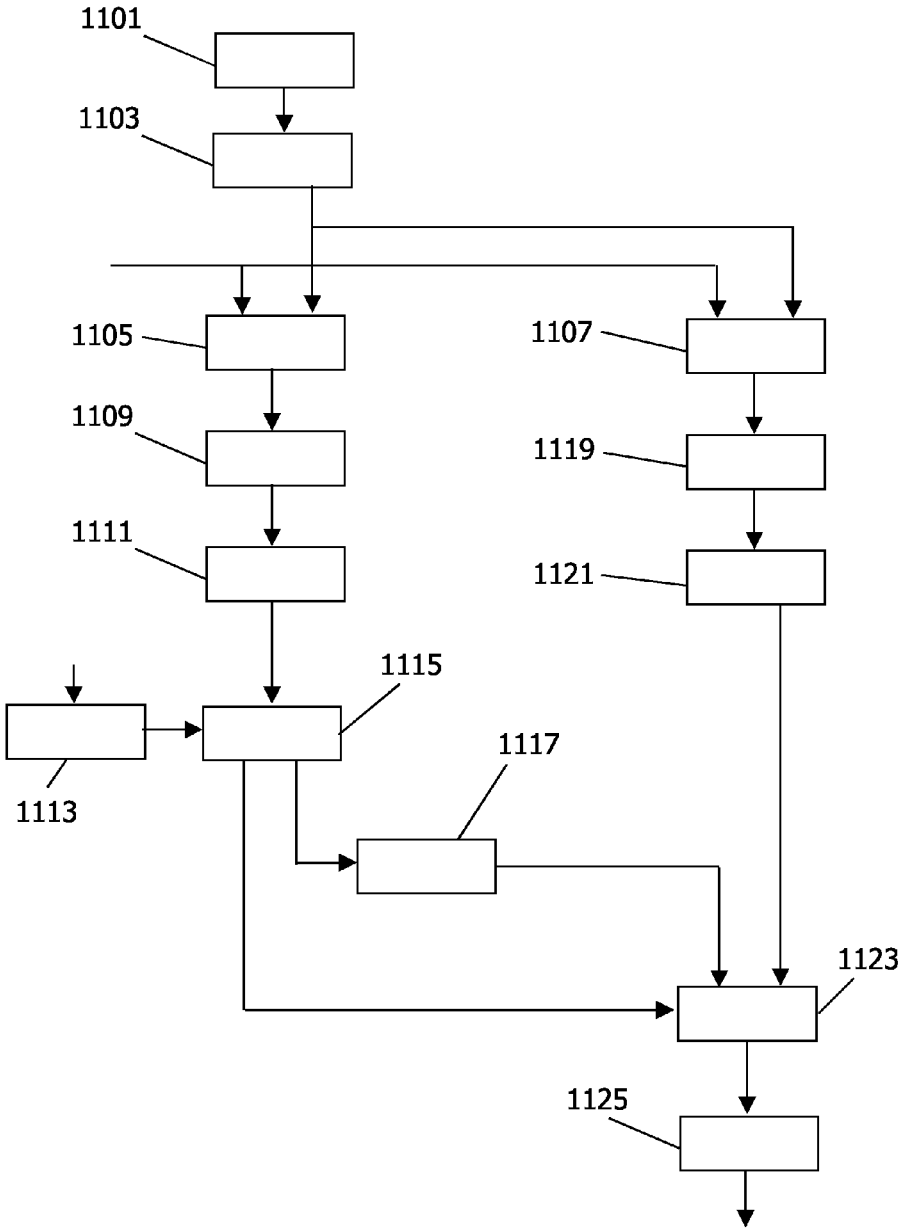
FIG. 11 illustrates an exemplary flow chart for a method of decoding in accordance with some embodiments of the invention.

FIG. 11 illustrates an exemplary flow chart for a method of decoding in accordance with some embodiments of the invention.

In step 1101, the quantized and coded parameters are decoded from the received bit-stream. As will be appreciated by the person skilled in the art, this may result in a number of vectors of conventional parametric audio coding parameters, such as:

$CLD_0$=[−10 15 10 12 . . . 10]
$CLD_1$=[5 1 2 15 10 . . . 2]
$ICC_0$=[1 0.6 0.9 0.3 . . . −1]
$ICC_1$=[0 1 0.6 0.9 . . . 0.3]
etc.

Each vector represents the parameters along the frequency axis.

Step 1101 is followed by step 1103 wherein the matrices for the individual up-mixers are determined from the decoded parametric data.

The (frequency independent) generalized OTT and TTT matrices may respectively be given as:

$$\begin{bmatrix} y_0 \\ y_1 \end{bmatrix} = \begin{bmatrix} H_{11} & H_{12} \\ H_{21} & H_{22} \end{bmatrix} \begin{bmatrix} x_0 \\ d_0 \end{bmatrix},$$

$$\begin{bmatrix} y_0 \\ y_1 \\ y_2 \end{bmatrix} = \begin{bmatrix} M_{11} & M_{12} & M_{13} \\ M_{21} & M_{22} & M_{23} \\ M_{31} & M_{32} & M_{33} \end{bmatrix} \begin{bmatrix} x_0 \\ x_1 \\ d_0 \end{bmatrix},$$

The signals $x_i$, $d_i$ and $y_i$ represent input signals, de-correlated signals derived from the signals $x_i$ and the output signals respectively. The matrix entries $H_{ij}$ and $M_{ij}$ are functions of the parameters derived in step 1103.

The method then divides into two parallel paths wherein one path is directed to deriving tree-pre matrix values (step 1105) and one path is directed to deriving tree-mix matrix values (step 1107).

The pre-matrices correspond to the matrix multiplications applied to the input signal before the de-correlation and the matrix application. Specifically, the pre-matrices correspond to the gain up-mixers applied to the input signal prior to the de-correlation filters.

Figure 9:
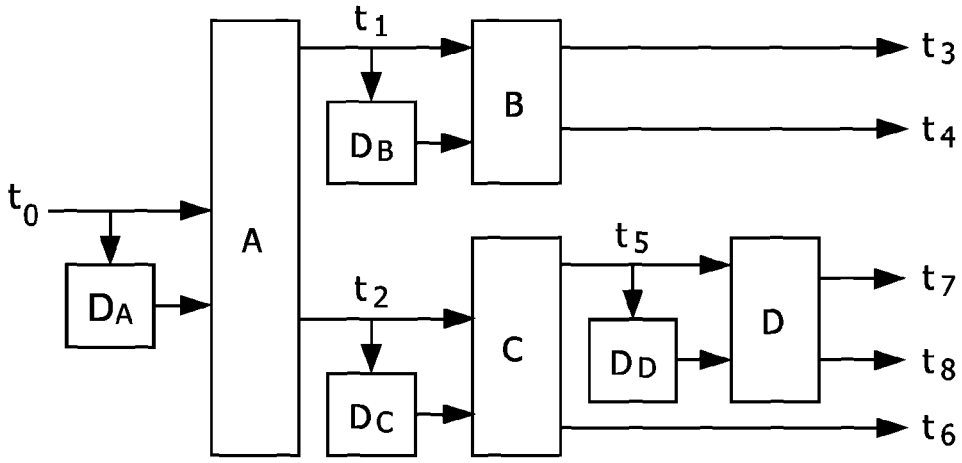
FIG. 9 illustrates an example of some hierarchical decoder structures that may be employed in some embodiments of the invention.
Figure 10:
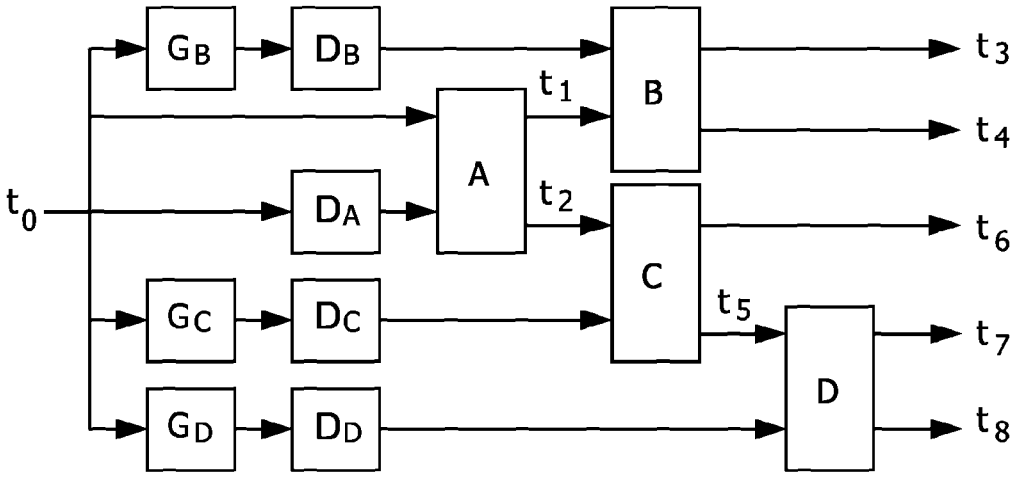
FIG. 10 illustrates an example of some hierarchical decoder structures that may be employed in some embodiments of the invention.

In more detail, a straightforward decoder implementation will in general lead to a cascade of de-correlation filters, as e.g. applied in FIG. 9. As explained above, it is preferable to prevent this cascading. In order to do so, the de-correlation filters are all moved to the same hierarchical level as shown in FIG. 10. In order to assure that the de-correlated signals have the appropriate energy level, i.e., identical to the level of the de-correlated signal in the straightforward case of FIG. 9, the pre-matrices are applied prior to the de-correlation.

As an example, the gain $G_B$ in FIG. 10 is derived as following. First, it is important to note that a 1-to-2 up-mixer divides the input signal power to the upper and lower output of the 1-to-2 up-mixer. This property is reflected in the Inter-channel Intensity Difference (IID) or Inter-channel Level Difference (ICLD) parameters. Hence, the gain $G_B$ is calculated as the energy ratio of the upper output divided by the sum of the upper and lower output of 1-to-2 up-mixer A. It will be appreciated that since the IID or ICLD parameters can be time- and frequency-variant, the gain may also vary both over time and frequency.

The mix matrices are the matrices applied to the input signal by the up-mixers in order to generate the additional channels.

The final pre- and mix-matrix equations are a result of a cascade of the OTT and TTT up-mixers. As the decoder structure has been amended to prevent a cascade of de-correlators this must be taken into account when determining the final equations.

In embodiments, where only predetermined configurations are used, the relationship between the matrix entries $H_{ij}$ and $M_{ij}$ and the final matrix equations is constant and a standard modification can be applied.

However, for the more flexible and dynamic approach previously described, the determination of the pre- and mix-matrix values can be determined through more complex approaches as will be described later.

Step 1105 is followed by step 1109 wherein the pre-matrices derived in step 1005 are mapped to the actual frequency grid that is applied to transform the time domain signal to the frequency domain (in step 1113).

Step 1109 is followed by step 1111 wherein interpolation of the frequency matrix parameters may be interpolated. Specifically, depending on whether or not the temporal update of the parameters corresponds to the update of the time-to-frequency transform of step 1113, interpolation may be applied.

In step 1113, the input signals are converted to the frequency domain in order to apply the mapped and optionally interpolated pre-matrices.

Step 1115 follows step 1111 and step 1113 and comprise applying the pre-matrices to the frequency domain input signals. The actual matrix application is a set of matrix multiplications.

Step 1115 is followed by step 1117 wherein part of the signals resulting from the matrix application of step 1115 is fed to a de-correlation filter to generate de-correlated signals.

The same approach is applied to derive the mix-matrix equations.

Specifically, step 1107 is followed by step 1119 wherein the equations determined in step 1107 are mapped to the frequency grid of the time-to-frequency transform of step 1113.

Step 1119 is followed by step 1121 wherein the mix-matrix values are optionally interpolated, again depending on the temporal update of parameters and transform.

The values generated in steps 1115, 1117 and 1121 thus form the parameters required for the up-mix matrix multiplication and this is performed in step 1123.

Step 1123 is followed by step 1125 wherein the resulting output is transformed back to the time domain.

Figure 12:
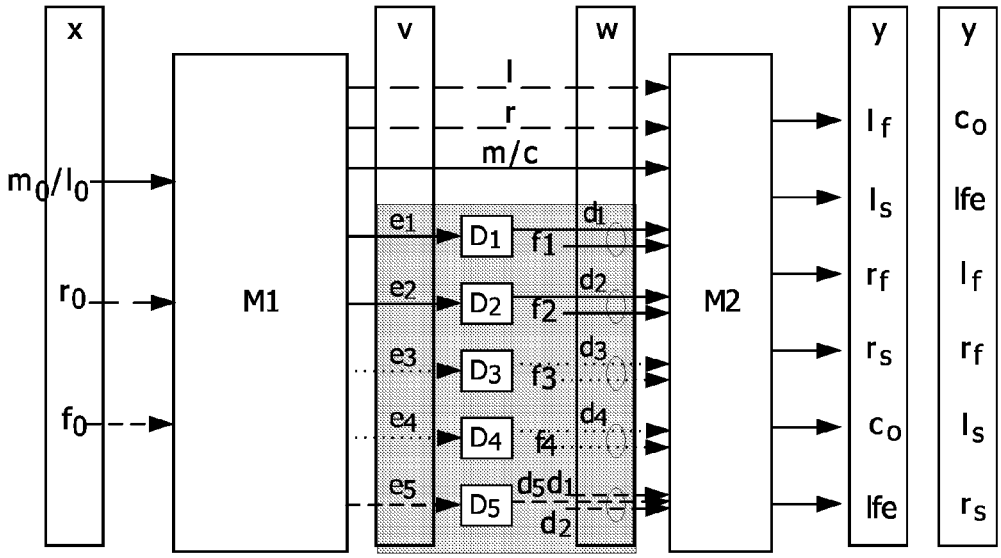
FIG. 12 illustrates an example of a matrix decoder structure in accordance with some embodiments of the invention.

The steps corresponding to steps 1115, 1117 and 1123 in FIG. 11 can be illustrated further by FIG. 12. FIG. 12 illustrates an example of a matrix decoder structure in accordance with some embodiments of the invention.

FIG. 12 illustrates how the input downmix channels can be used to re-construct the multi-channel output. As outlined above, the process can be described by two matrix multiplications with intermediate decorrelation units.

Hence, the processing of the input channels to form the output channels can be described according to:

$$v^{n,k}=M_1^{n,k}x^{n,k}$$

$$y^{n,k}=M_2^{n,k}w^{n,k}$$

where $M_1^{n,k}$ is a two dimensional matrix mapping a certain number of input channels to a certain number of channels going into the decorrelators, and is defined for every time-slot n, and every subband k; and $M_2^{n,k}$ is a two dimensional matrix mapping a certain number of pre-processed channels to a certain number of output channels, and is defined for every time-slot n, and every hybrid subband k.

In the following an example of how the pre- and mix-matrix equations of steps 1105 and 1107 may be generated from the decoder tree structure data will be described.

Figure 13:
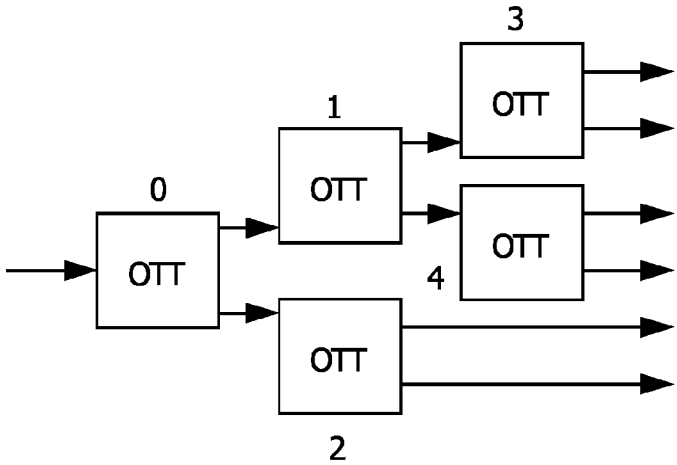
FIG. 13 illustrates an example of a hierarchical decoder structure that may be employed in some embodiments of the invention.

Firstly, decoder tree structures having only OTT up-mixers will be considered with reference to the exemplary tree of FIG. 13.

For this type of trees it is beneficial to define a number of helper variables:

$$Tree^1=\begin{bmatrix} 0 & 1 & 2 & 3 & 4 \\ & 0 & 0 & 1 & 1 \\ & & & 0 & 0 \end{bmatrix},$$

describes the OTT up-mixer indices that are encountered for each OTT up-mixer (i.e. in the example, the signal being input to the $4^{th}$ OTT up-mixer has passed through the $0^{th}$ and $1^{st}$ OTT up-mixer, as given by the $5^{th}$ column in the $Tree^1$ matrix. Similarly, the signal being input to the $2^{nd}$ OTT up-mixer has passed through the $0^{th}$ OTT box, as given by the $3^{rd}$ column in the $Tree^1$ matrix, and so on).

$$Tree^1_{sign}=\begin{bmatrix} 1 & 1 & 1 & 1 & 1 \\ & 1 & -1 & 1 & -1 \\ & & & 1 & 1 \end{bmatrix},$$

describes whether the upper or the lower path is pursued for each OTT up-mixer. A positive sign indicates the upper path, and a negative sign indicates the lower path.

The matrix corresponds to the $Tree^1$ matrix, and hence when a certain column and row in the $Tree^1$ matrix points out a certain OTT up-mixer, the same column and row in the $Tree_{sign}^1$ matrix indicates if the lower or upper part of that specific OTT up-mixer is used to reach the OTT up-mixer given in the first row of the specific column. (i.e. in the example, the signal being input to the 4th OTT up-mixer has passed through the upper path of the 0th OTT up-mixer (as indicated by the $3^{rd}$ row, $5^{th}$ column in the $Tree_{sign}^1$ matrix), and the lower path of the $1^{st}$ OTT up-mixer (as indicated by the $2^{nd}$ row, $5^{th}$ column in the $Tree_{sign}^1$ matrix).

$$Tree_{depth}^1=[1\ 2\ 2\ 3\ 3]$$

describes the depth of the tree for each OTT up-mixer (i.e. in the example up-mixer 0 is at layer 1, up-mixer 1 and 2 are at layer 2 and the up-mixer 3 and 4 are at layer 3); and $$Tree_{elements}=[5]$$

denotes the number of elements in the tree (i.e. in the example, the tree comprises five up-mixers).

A temporary matrix $K_1$ describing the pre-matrix for only the de-correlated signals is then defined according to:

$$K_1(i)=\begin{cases} \prod_{p=0}^{Tree_{depth}(i-1)-1} X_{tree(i,p)}, & Tree_{depth}(i-1)>1,\ i>0 \\ 1, & \text{otherwise} \end{cases},$$

for $0 \le i \le Tree_{elements}$ where $$X_{Tree^1(i,p)}=\begin{cases} c_{l,Tree^1(i,p)}, & Tree^1_{sign}(i,p)=1 \\ c_{r,Tree^1(i,p)}, & Tree^1_{sign}(i,p)=-1 \end{cases}$$

is the gain value for the OTT up-mixer indicated by $Tree^1(i,p)$ depending on whether the upper or lower output of the OTT box is used, and where $$c_{l,X}=\sqrt{\frac{IID^2_{lin,X}}{1+IID^2_{lin,X}}} \text{ and } c_{r,X}=\sqrt{\frac{1}{1+IID^2_{lin,X}}},$$

where $IID_{lin,X}=10^{\frac{IID_X}{20}}$.

The IID values are the Inter-channel Intensity Difference values obtained from the bitstream.

The final pre-mix matrix $M_1$ is then constructed as:

$$M_1(i)=\begin{bmatrix} 1 \\ K_1(i) \end{bmatrix}.$$

Remembering that the objective of the pre-mix matrix is to be able to move the decorrelators included in the OTT up-mixer in FIG. 13, prior to the OTT boxes. Hence, the pre-mix matrix needs to supply a "dry" input signal for all decorrelators in the OTT up-mixer, where the input signals have the level they would have had at the specific point in the tree where the decorrelator was situated prior to moving it in front of the tree.

Also remembering that the pre-matrix only applies a pre-gain for signals going into decorrelators, and the mixing of the decorrelator signals and the "dry" downmix signal takes place in the mix-matrix $M_2$, which will be elaborated on below, the first element of the pre-mix matrix gives an output that is directly coupled to the $M_2$ matrix (see FIG. 12, where the m/c line illustrates this).

Given that a OTT up-mixer only tree is currently being observed, it is clear that also the second element of the pre-mix vector $M_1$ will be one, since the signal going into the decorrelator in OTT up-mixer zero, is exactly the downmix input signal, and that there for this OTT up-mixer is no difference to move the decorrelator in front of the whole tree since it is already first in the tree.

Furthermore, given that the input vector to the decorrelators are given by $v^{n,k}=M_1^{n,k}x^{n,k}$ and observing FIG. 13, and FIG. 12, and the way the elements in the $M_1^{n,k}$ matrix were derived, it is clear that the first row of M1 corresponds to the m signal in FIG. 12, the subsequent rows corresponds to the decorrelator input signal of OTT box 0, . . . , 4. Hence, the $w^{n,k}$ vector will be as following:

$$w^{n,k} = \begin{bmatrix} m \\ e_0 \\ e_1 \\ e_2 \\ e_3 \\ e_4 \end{bmatrix}$$

where $e_n$ denotes the decorrelator output from the $n^{th}$ OTT box in FIG. 13.

Now observing the mix matrix $M_2$ the elements of this matrix can be deducted similarly. However, for this matrix the objective is to gain adjust the dry signal and mix it with the relevant decorrelator outputs. Remembering that the every OTT up-mixer in the tree can be described by the following:

$$\begin{bmatrix} Y_1[k] \\ Y_2[k] \end{bmatrix} = \begin{bmatrix} H11 & H12 \\ H21 & H22 \end{bmatrix} \begin{bmatrix} X[k] \\ Q[k] \end{bmatrix}$$

where, $Y_1$ is the upper output of the OTT box, and $Y_2$ is the lower and X is the dry input signal and Q is the decorrelator signal.

Since the output channels are formed by the matrix multiplication $y^{n,k}=M_2^{n,k}w^{n,k}$ and the $w^{n,k}$ vector is formed as a combination of the downmix signal and the output of the decorrelators as indicated by FIG. 12, every row of the $M_2$ matrix corresponds to an output channel, and every element in the specific row, indicates how much of the downmix signal and the different decorrelators that should be mixed to form the specific output channel.

As an example the first row of the mix matrix $M_2$ can be observed.

$$\begin{aligned} y^{n,k} &= M_2^{n,k} = w^{n,k} \\ &= [\,H11_0 H11_1 H11_3 \quad H12_0 H11_1 H11_3 \quad H12_1 H11_3 \quad 0 \quad H12_3 \quad 0\,] \\ &\quad \begin{bmatrix} m \\ e_0 \\ e_1 \\ e_2 \\ e_3 \\ e_4 \end{bmatrix} \end{aligned}$$

The first element of the first row in $M_2$ corresponds to the contribution of the "m" signal, and is the contribution to the output given by the upper outputs of OTT up-mixer 0, 1 and 3. Given the H matrix above, this corresponds to $H11_0$, $H11_1$ and $H11_3$, since the amount of dry signal for the upper output of an OTT box is given by the H11 element of the OTT up-mixer.

The second element corresponds to the contribution of de-correlator D1, which according to the above is situated in OTT up-mixer 0. Hence, the contribution of this is $H11_0$, $H11_3$ and $H12_0$. This is evident, since the $H12_0$ element gives the decorrelator output from OTT up-mixer 0, and that signal is subsequently passed through OTT up-mixer 1 and 3, as part of the dry signal, and thus gain adjusted according to the $H11_0$ and $H11_3$ elements.

Similarly, the third element corresponds to the contribution of the de-correlator D2, which according to the above is situated in OTT up-mixer 1. Hence, the contribution of this is $H12_0$ and $H11_3$.

The fifth element corresponds to the contribution of the de-correlator D3, which according to the above notation is situated in OTT up-mixer 3. Hence, the contribution of this is $H12_3$.

The fourth and sixth element of the first row is zero since no contribution of de-correlator D4 or D6 is part of the output channel corresponding to the first row in the matrix.

The above, walk-trough example makes it evident that the matrix elements can be deducted as products of OTT up-mixer matrix elements H.

In order to derive the mix-matrix $M_2$ for a general tree, a similar procedure as for matrix $M_1$ can be derived. First the following helper variables are derived:

The matrix Tree, holds a column for every out channel, describing the indexes of the OTT up-mixers the signal must pass to reach each output channel.

$$\text{Tree} = \begin{bmatrix} 0 & 0 & 0 & 0 & 0 & 0 \\ 1 & 1 & 1 & 1 & 2 & 2 \\ 3 & 3 & 4 & 4 & & \end{bmatrix}$$

The matrix $\text{Tree}_{sign}$ holds an indicator for every up-mixer in the tree to indicate if the upper (1) or lower (−1) path should be used to reach the current output channel.

$$Tree_{sign} = \begin{bmatrix} 1 & 1 & 1 & 1 & -1 & -1 \\ 1 & 1 & -1 & -1 & 1 & -1 \\ 1 & -1 & 1 & -1 & & \end{bmatrix}$$

The $\text{Tree}_{depth}$ vector holds the number of up-mixers that must be passed to get to a specific output channel.

$\text{Tree}_{depth}$=[3 3 3 3 2 2]

The $\text{Tree}_{elements}$ vector holds the number of up-mixers in every sub tree of the whole tree $\text{Tree}_{elements}$=[5].

Provided that the above defined notation is sufficient to describe all trees that can be signaled, the $M_2$ matrix can be defined. The matrix for a sub-tree k, creating N output channels from 1 input channel is defined according to:

$$M_2(j, i) = \begin{cases} \left.\begin{cases} \prod_{p=max(0,i-1)}^{Tree_{depth}(j)-1} X_{Tree(p,j)} & i = 0 \text{ or } (i-1) \in \begin{Bmatrix} \text{Tree}(0, j) \ldots \text{Tree} \\ (Tree_{depth}(j)-1, j) \end{Bmatrix} \\ 0 & \text{otherwise} \end{cases}\right\} & Tree_{depth}(j) > 0 \\ 1 & \text{otherwise} \end{cases}$$

for $$\begin{cases} 0 \le j < Tree_{outChannels} \\ 0 \le i \le Tree_{elements} \end{cases}$$

-continued where $$X_{Tree(p,j)} = \begin{cases} H11_{Tree(p,j)} \\ H12_{Tree(p,j)} \\ H21_{Tree(p,j)} \\ H22_{Tree(p,j)} \end{cases}$$

$$\left.\begin{matrix} p \neq \max(0, i-1) \text{ OR } i = 0 \\ p = \max(0, i-1) \text{ AND } i \neq 0 \end{matrix}\right\}, \quad Tree_{sign}(p, j) = 1$$

$$\left.\begin{matrix} p \neq \max(0, i-1) \text{ OR } i = 0 \\ p = \max(0, i-1) \text{ AND } i \neq 0 \end{matrix}\right\}, \quad Tree_{sign}(p, j) = -1$$

where the H elements are defined by the parameters corresponding to the OTT up-mixer with index Tree(p,j).

Figure 14:
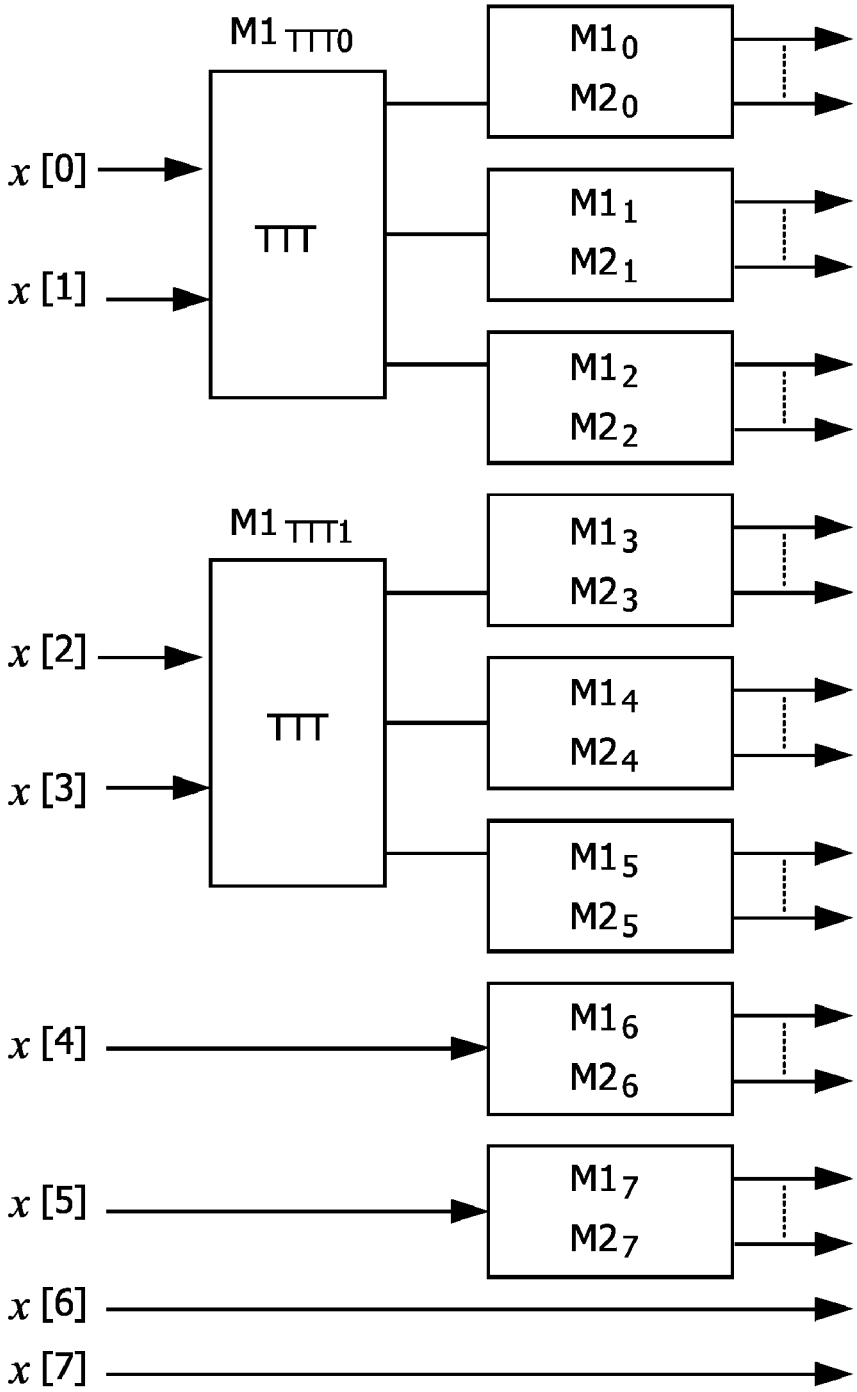
FIG. 14 illustrates an example of a hierarchical decoder structure that may be employed in some embodiments of the invention.

In the following a more general tree involving TTT up-mixers at the root level is assumed, such as for example the decoder structure of FIG. 14. The up-mixers containing two variables $M1_i$ and $M2_i$ denote OTT trees and thus not necessarily single OTT up-mixers. Furthermore, at first it is assumed that the TTT up-mixers do not employ a de-correlated signal, i.e., the TTT matrix can be described as a 3×2 matrix:

$$M1_{TTT} = \begin{bmatrix} M1_{TTT}^{0,0} & M1_{TTT}^{0,1} \\ M1_{TTT}^{1,0} & M1_{TTT}^{1,1} \\ M1_{TTT}^{2,0} & M1_{TTT}^{2,1} \end{bmatrix}$$

Under these assumptions and in order to derive the final pre- and mix-matrices for the first TTT up-mixer, two sets of pre-mix matrices are derived for each OTT tree, one describing the pre-matrixing for the first input signal of the TTT up-mixer and one describing the pre-matrixing for the second input signal of the TTT up-mixer. After application of both pre-matrixing blocks and de-correlation the signals can be summed.

The output signals may thus be derived as the following:

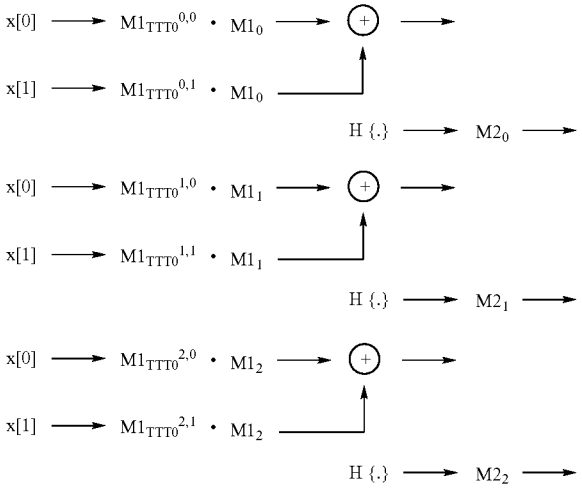

-continued

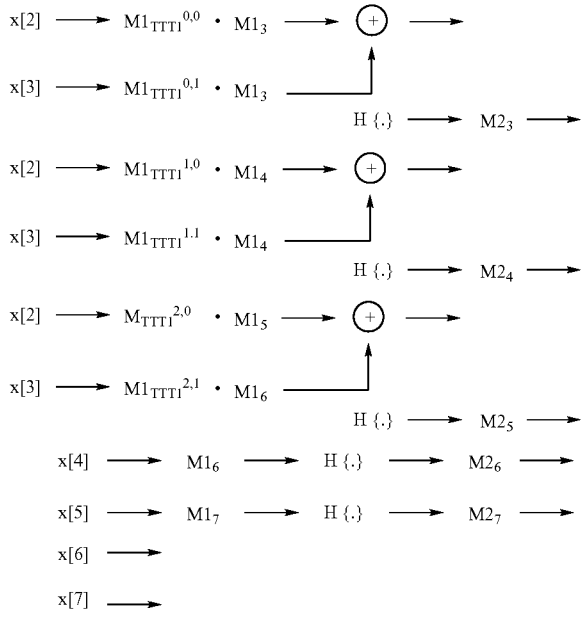

Finally, in case the TTT up-mixer would employ de-correlation, the contribution of the de-correlated signal can be added in the form of a post-process. After the TTT up-mixer de-correlated signal has been derived, the contribution to each output signal is simply the contribution given by the $[M_{13}, M_{23}, M_{33}]$ vector spread by the IIDs of each following OTT up-mixer.

Figure 15:
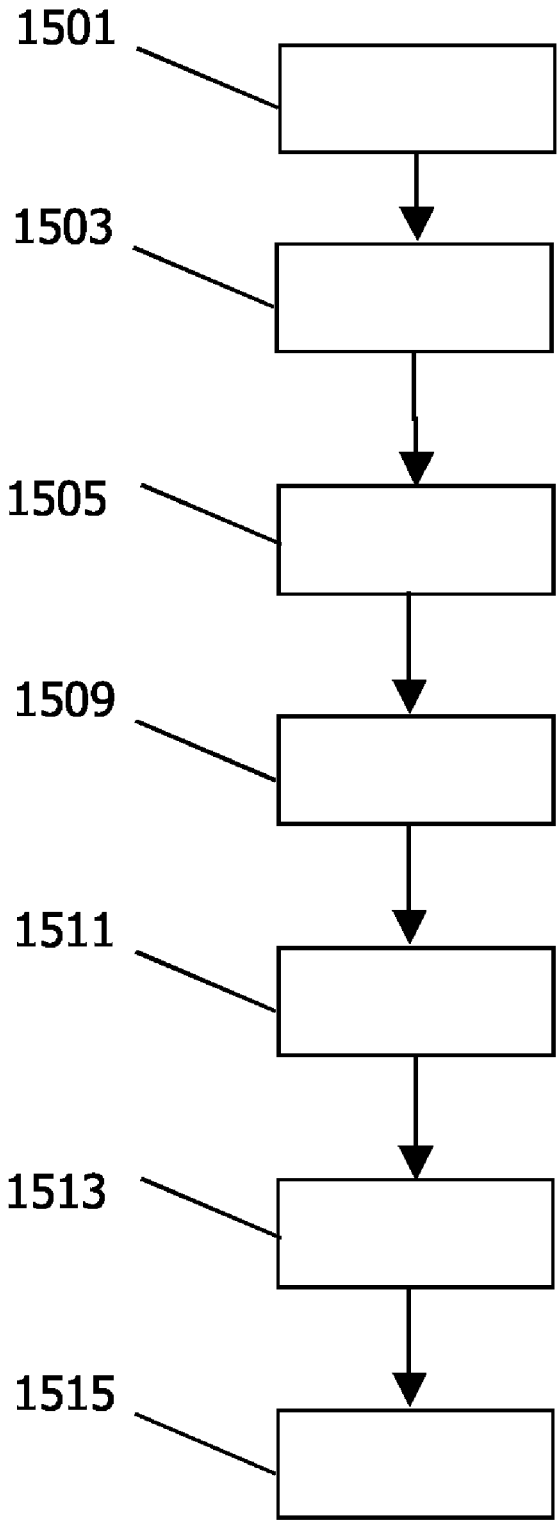
FIG. 15 illustrates a method of transmitting and receiving an audio signal in accordance with some embodiments of the invention.

FIG. 15 illustrates a method of transmitting and receiving an audio signal in accordance with some embodiments of the invention.

The method initiates in step 1501 wherein a transmitter receives a number of input audio channels.

Step 1501 is followed by step 1503 wherein the transmitter parametrically encodes the number of input audio channels to generate the data stream comprising the number of audio channels and parametric audio data.

Step 1503 is followed by step 1505 wherein the hierarchical decoder structure corresponding to the hierarchical encoding means is determined.

Step 1505 is followed by step 1507 wherein the transmitter includes decoder tree structure data comprising at least one data value indicative of a channel split characteristic for an audio channel at a hierarchical layer of the hierarchical decoder structure in the data stream.

Step 1507 is followed by step 1509 wherein the transmitter transmits the data stream to the receiver.

Step 1509 is followed by step 1511 wherein a receiver receives the data stream.

Step 1511 is followed by step 1513 wherein the hierarchical decoder structure to be used by the receiver is determined in response to the decoder tree structure data.

Step 1513 is followed by step 1515 wherein the receiver generates the number of output audio channels from the data stream using the hierarchical decoder structure.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An apparatus for generating a number of output audio channels, comprising:

means for receiving a data stream comprising a number of input audio channels and parametric audio data, the data stream further comprising decoder tree structure data for a hierarchical decoder structure, the decoder tree structure data comprising at least one data value indicative of channel split characteristics for an audio channel at a hierarchical layer of the hierarchical decoder structure;

means for generating the hierarchical decoder structure in response to the decoder tree structure data; and means for generating the number of output audio channels from the data stream using the hierarchical decoder structure.

2. The apparatus of claim 1, wherein the decoder tree structure data comprises a plurality of data values, each data value indicative of a channel split characteristic for one channel at one hierarchical layer of the hierarchical decoder structure.

3. The apparatus of claim 2, wherein a predetermined data value is indicative of no channel split for the channel at the hierarchical layer.

4. The apparatus of claim 2, wherein a predetermined data value is indicative of a one-to-two channel split for the channel at the hierarchical layer.

5. The apparatus of claim 2, wherein the plurality of data values are binary data values.

6. The apparatus of claim 5, wherein one predetermined binary data value is indicative of a one-to-two channel split and another predetermined binary data value is indicative of no channel split.

7. The apparatus of claim 1, wherein the data stream further comprises an indication of the number of input channels.

8. The apparatus of claim 1, wherein the data stream further comprises an indication of the number of output channels.

9. The apparatus of claim 1, wherein the data stream further comprises an indication of a number of one-to-two channel split functions in the hierarchical decoder structure.

10. The apparatus of claim 1, wherein the data stream further comprises an indication of a number of two-to-three channel split functions in the hierarchical decoder structure.

11. The apparatus of claim 1, wherein the decoder tree structure data comprises a data for a plurality of decoder tree structures ordered in response to the presence of a two-to-three channel split functionality.

12. The apparatus of claim 1, wherein the decoder tree structure data for at least one input channel comprises an indication of a two-to-three channel split function being present at the root layer followed by binary data wherein each binary data value is indicative of either no split functionality or a one-to-two channel split functionality for dependent layers of the two-to-three split functionality.

13. The apparatus of claim 1, wherein the data stream further comprises an indication of a loudspeaker position for at least one of the output channels.

14. The apparatus of claim 1, wherein the means for generating the hierarchical decoder structure is arranged to determine multiplication parameters for channel split functions of the hierarchical layers in response to the decoder tree structure data.

15. The apparatus of claim 1, wherein the decoder tree structure comprises at least one channel split functionality in at least one hierarchical layer, the at least one channel split functionality comprising:

de-correlation means for generating a de-correlated signal directly from an audio input channel of the data stream;

at least one channel split unit for generating a plurality of hierarchical layer output channels from an audio channel from a higher hierarchical layer and the de-correlated signal; and means for determining at least one characteristic of the de-correlation filter or the channel split unit in response to the decoder tree structure data.

16. The apparatus of claim 15, wherein the de-correlation means comprises a level compensation means for performing an audio level compensation on the audio input channel to generate a level compensated audio signal, and a de-correlation filter for filtering the level compensated audio signal to generate the de-correlated signal.

17. The apparatus of claim 16, wherein the level compensation means comprises a matrix multiplication by a pre-matrix.

18. The apparatus of claim 17, wherein the coefficients of the pre-matrix have at least one unity value for a hierarchical decoder structure comprising only one-to-two channel split functionality.

19. The apparatus of claim 17, further comprising means for determining the pre-matrix for the at least one channel split functionality in the at least one hierarchical layer in response to parameters of a channel split functionality in a higher hierarchical layer.

20. The apparatus of claim 17, wherein the apparatus comprises means for determining a channel split matrix for the at least one channel split functionality in response to parameters of the at least one channel split functionality in the at least one hierarchical layer.

21. The apparatus of claim 17, further comprising means for determining the pre-matrix for the at least one channel split functionality in the at least one hierarchical layer in response to parameters of a two-to-three channel split functionality of a higher hierarchical layer.

22. The apparatus of claim 21, wherein the means for determining the pre-matrix is arranged to determine the pre-matrix for the at least one channel split functionality in response to determine a first sub-pre-matrix corresponding to a first input of the two-to-three up-mixer and a second sub-pre-matrix corresponding to a second input of the two-to-three up-mixer.

23. An apparatus for generating a data stream comprising a number output audio channels, the apparatus comprising:

means for receiving a number of input audio channels;

hierarchical encoding means for parametrically encoding the number of input audio channels to generate the data stream comprising the number of output audio channels and parametric audio data;

means for determining a hierarchical decoder structure corresponding to the hierarchical encoding means; and means for including decoder tree structure data comprising at least one data value indicative of a channel split characteristic for an audio channel at a hierarchical layer of the hierarchical decoder structure in the data stream.

24. A method of generating a number of output audio channels, comprising:

receiving a data stream comprising a number of input audio channels and parametric audio data; the data stream further comprising decoder tree structure data for a hierarchical decoder structure, the decoder tree structure data comprising at least on data value indicative of channel split characteristics for an audio channel at a hierarchical layer of the hierarchical decoder structure;

generating the hierarchical decoder structure in response to the decoder tree structure data; and generating the number of output audio channels from the data stream using the hierarchical decoder structure.

25. A method of generating a data stream comprising a number of output audio channels, the method comprising:

receiving a number of input audio channels;

parametrically encoding the number of input audio channels to generate the data stream comprising the number of output audio channels and parametric audio data;

determining a hierarchical decoder structure corresponding to the hierarchical encoding means; and including decoder tree structure data comprising at least one data value indicative of a channel split characteristic for an audio channel at a hierarchical layer of the hierarchical decoder structure in the data stream.

26. A receiver for generating a number of output audio channels, comprising:

means for receiving a data stream comprising a number of input audio channels and parametric audio data; the data stream further comprising decoder tree structure data for a hierarchical decoder structure, the decoder tree structure data comprising at least on data value indicative of channel split characteristics for an audio channel at a hierarchical layer of the hierarchical decoder structure;

means for generating the hierarchical decoder structure in response to the decoder tree structure data; and means for generating the number of output audio channels from the data stream using the hierarchical decoder structure.

27. A transmitter for generating a data stream comprising a number of output audio channels, the transmitter comprising:

means for receiving a number of input audio channels;

hierarchical encoding means for parametrically encoding the number of input audio channels to generate the data stream comprising the number of output audio channels and parametric audio data;

means for determining a hierarchical decoder structure corresponding to the hierarchical encoding means; and means for including decoder tree structure data comprising at least one data value indicative of a channel split characteristic for an audio channel at a hierarchical layer of the hierarchical decoder structure in the data stream.

28. A transmission system comprising a transmitter for generating a data stream and a receiver for generating a number of output audio channels, wherein the transmitter comprises:

means for receiving a number of input audio channels, hierarchical encoding means for parametrically encoding the number of input audio channels to generate the data stream comprising the number of audio channels and parametric audio data, means for determining a hierarchical decoder structure corresponding to the hierarchical encoding means, means for including decoder tree structure data comprising at least one data value indicative of a channel split characteristic for an audio channel at a hierarchical layer of the hierarchical decoder structure in the data stream, and means for transmitting the data stream to the receiver; and the receiver comprises:

means for receiving the data stream, means for generating the hierarchical decoder structure in response to the decoder tree structure data, and means for generating the number of output audio channels from the data stream using the hierarchical decoder structure.

29. A method of receiving a data stream, comprising:

receiving a data stream comprising a number of input audio channels and parametric audio data; the data stream further comprising decoder tree structure data for a hierarchical decoder structure, the decoder tree structure data comprising at least on data value indicative of channel split characteristics for an audio channel at a hierarchical layer of the hierarchical decoder structure;

generating the hierarchical decoder structure in response to the decoder tree structure data; and generating the number of output audio channels from the data stream using the hierarchical decoder structure.

30. A method of transmitting a data stream comprising a number of output audio channels, the method comprising:

receiving a number of input audio channels;

parametrically encoding the number of input audio channels to generate the data stream comprising the number of output audio channels and parametric audio data;

determining a hierarchical decoder structure corresponding to the hierarchical encoding means;

including decoder tree structure data comprising at least one data value indicative of a channel split characteristic for an audio channel at a hierarchical layer of the hierarchical decoder structure in the data stream; and transmitting the data stream.

31. A method of transmitting and receiving a data stream, the method comprising:

at a transmitter:

receiving a number of input audio channels, parametrically encoding the number of input audio channels to generate the data stream comprising the number of audio channels and parametric audio data, determining a hierarchical decoder structure corresponding to the hierarchical encoding means, including decoder tree structure data comprising at least one data value indicative of a channel split characteristic for an audio channel at a hierarchical layer of the hierarchical decoder structure in the data stream, and transmitting the data stream to the receiver; and at a receiver:

receiving the data stream, generating the hierarchical decoder structure in response to the decoder tree structure data, and generating the number of output audio channels from the data stream using the hierarchical decoder structure.

* * * * *